United States Patent [19]

Dobler et al.

[11] 4,015,804

[45] Apr. 5, 1977

[54] SYSTEM FOR THE DEMAND-DEPENDENT CONTROL OF GUIDED VEHICLES

[75] Inventors: Karl Ulrich Dobler, Waiblingen; Wolfgang Jakob, Ludwigsburg; Klaus Eltzschig, Korntal; Helmut Ubel, Stuttgart, all of Germany

[73] Assignee: International Standard Electric Corporation, New York, N.Y.

[22] Filed: Feb. 6, 1976

[21] Appl. No.: 655,913

Related U.S. Application Data

[63] Continuation-in-part of Ser. No. 577,148, May 13, 1975, abandoned.

[30] Foreign Application Priority Data

May 15, 1974 Germany ..... 2423590

[52] U.S. Cl. ..... 246/5; 235/150.24

[51] Int. Cl.[2] ..... B61L 27/00

[58] Field of Search ..... 246/5, 4, 3, 34 R, 62, 246/167 R; 340/31 R; 235/150.24

[56] References Cited

UNITED STATES PATENTS

| | | | |
|---|---|---|---|
| 3,064,126 | 11/1962 | Jachino | 246/5 |
| 3,250,914 | 5/1966 | Reich | 246/5 |
| 3,740,548 | 6/1973 | Hoyler | 246/3 |
| 3,836,768 | 9/1974 | Clarke | 246/5 |

*Primary Examiner*—Trygve M. Blix
*Assistant Examiner*—Reinhard J. Eisenzopf
*Attorney, Agent, or Firm*—John T. O'Halloran; Alfred C. Hill

[57] ABSTRACT

The system includes equipments necessary for demand registration and control organized hierarchically. The uppermost hierarchy level includes an operations control center and station equipment connected to the operations control center. The operations control center indicates the operation necessary at the next hierarchy level in accordance with the demand registered in the station equipment. The next hierarchy level includes one or more command and control centers. Each command and control center checks the commands of the operations control center and/or of the associated station equipment, giving special consideration to safety criteria, and passes on the commands to the last hierarchy level for execution. The last hierarchy level includes operation facilities, such as vehicles, which perform the requested transport tasks, continuously exchanging information with their associated command and control center.

6 Claims, 29 Drawing Figures

TO VOBC
INVERTER
139
MONOSTABLE MULTIVIBRATOR
137
MONOSTABLE MULTIVIBRATOR
138
140
INVERTER
ON BOARD TRANSMITTER Tx
135
ON BOARD RECEIVER Rx
136
ON BOARD ANTENNA
134
VEHICLE
GUIDEWAY
132
GUIDEWAY MARKER 131
133

FROM PERIPHERAL EQUIPMENT AND INTERFACE
TO PERIPHERAL EQUIPMENT AND INTERFACE
154
SERIAL TELEGRAM
CROSSOVER DETECTION
DIGITAL RECEIVER
162
DIGITAL RECEIVER
161
CLOCK INTERRUPT UNIT
163
CPU 2 CENTRAL PROCESSING UNIT
159
CPU 1 CENTRAL PROCESSING UNIT
158
DIGITAL TRANSMITTER
165
DIGITAL TRANSMITTER
164
PROCESSING UNIT
SUPERVISION UNIT
160
E8
SERIAL TELEGRAM

COMPUTER I/O BOX

CH0 → 15
16 CHANNELS
R1
O/P 1200 Bd
R2
O/P 1200 Bd
16
R3
O/P 1200 Bd
16
(UP TO 16 INDUCTIVE LOOPS)
COMPARATOR VGL 1&2
Cp. V1
12
12
V1
Cp.
F1
F2
DECISION CIRCUIT FEZ
AV (1-2, 2-3, 1-3)
3
3
Cp.
T0
LOGIC CIRCUIT FESP 6
3

IRS
Cp.
IRZ
SELECTION LOGIC AWL
AS(R1,R2,R3)
3
3
THROUGH SWITCH DSCHA
3
ADBZ(R1,R2,R3)
3
3
THROUGH SWITCHES DSCH B1-4
3
3
TO LOOP MODEMS
TO VGEIN (1,2,3)

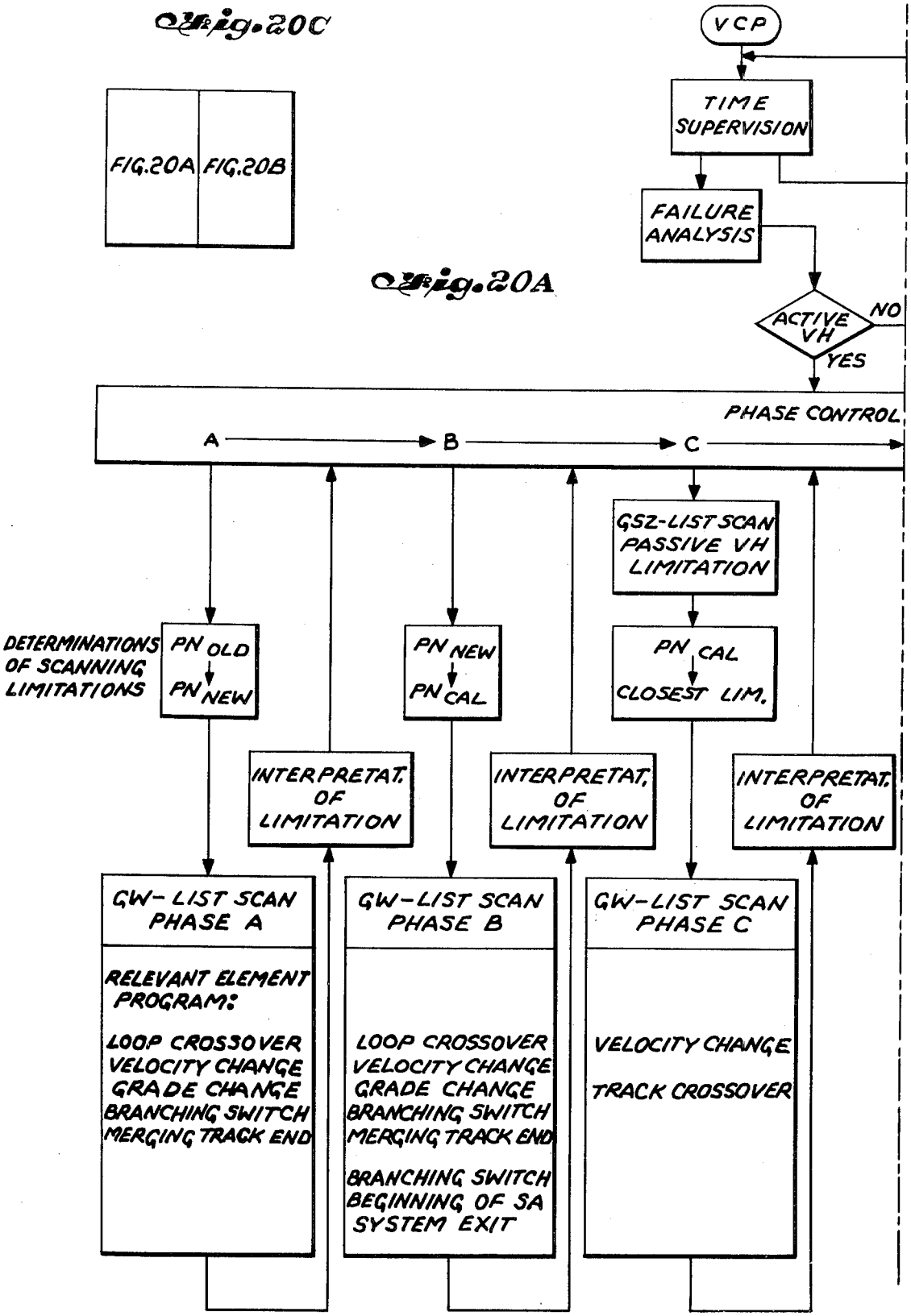
Fig. 20C
FIG.20A
FIG.20B
Fig. 20A
VCP
TIME SUPERVISION
FAILURE ANALYSIS
ACTIVE VH
NO
YES
PHASE CONTROL
A
B
C
GSZ-LIST SCAN PASSIVE VH LIMITATION
DETERMINATIONS OF SCANNING LIMITATIONS
PN OLD
PN NEW
PN NEW
PN CAL
PN CAL
CLOSEST LIM.
INTERPRETAT. OF LIMITATION
INTERPRETAT. OF LIMITATION
INTERPRETAT. OF LIMITATION
GW-LIST SCAN PHASE A
RELEVANT ELEMENT PROGRAM:
LOOP CROSSOVER
VELOCITY CHANGE
GRADE CHANGE
BRANCHING SWITCH
MERGING TRACK END
GW-LIST SCAN PHASE B
LOOP CROSSOVER
VELOCITY CHANGE
GRADE CHANGE
BRANCHING SWITCH
MERGING TRACK END
BRANCHING SWITCH
BEGINNING OF SA SYSTEM EXIT
GW-LIST SCAN PHASE C
VELOCITY CHANGE
TRACK CROSSOVER

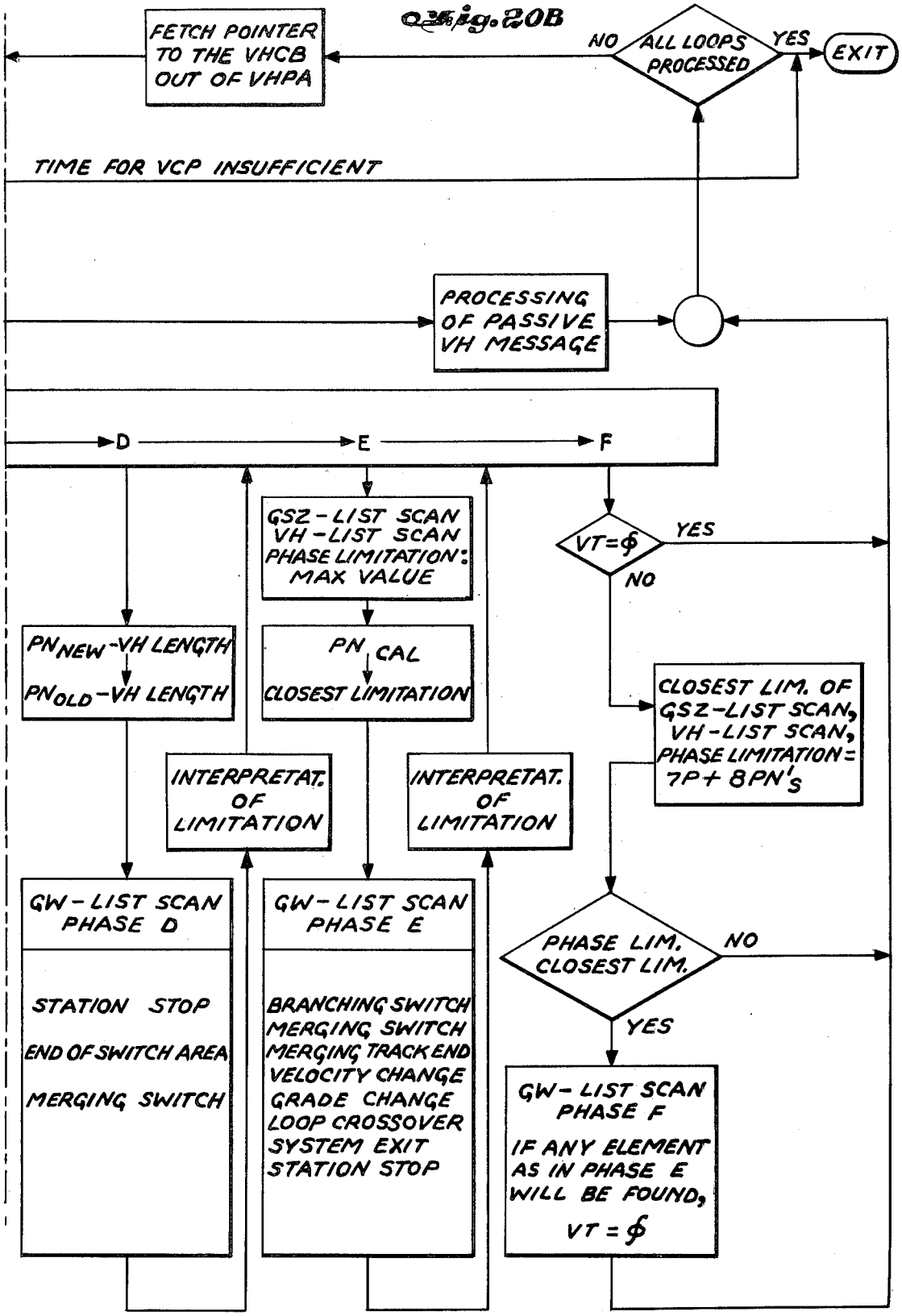
Fig. 20B
FETCH POINTER TO THE VHCB OUT OF VHPA
NO
ALL LOOPS PROCESSED
YES
EXIT
TIME FOR VCP INSUFFICIENT
PROCESSING OF PASSIVE VH MESSAGE
D
E
F
GSZ - LIST SCAN
VH - LIST SCAN
PHASE LIMITATION: MAX VALUE
VT=ϕ
YES
NO
PN NEW - VH LENGTH
PN OLD - VH LENGTH
PN CAL
CLOSEST LIMITATION
CLOSEST LIM. OF GSZ-LIST SCAN, VH-LIST SCAN, PHASE LIMITATION = 7P + 8PN'S
INTERPRETAT. OF LIMITATION
INTERPRETAT. OF LIMITATION
GW - LIST SCAN PHASE D
STATION STOP
END OF SWITCH AREA
MERGING SWITCH
GW - LIST SCAN PHASE E
BRANCHING SWITCH
MERGING SWITCH
MERGING TRACK END
VELOCITY CHANGE
GRADE CHANGE
LOOP CROSSOVER
SYSTEM EXIT
STATION STOP
PHASE LIM. CLOSEST LIM.
NO
YES
GW - LIST SCAN PHASE F
IF ANY ELEMENT AS IN PHASE E WILL BE FOUND, VT = ϕ

SYSTEM FOR THE DEMAND-DEPENDENT CONTROL OF GUIDED VEHICLES

CROSS-REFERENCE TO RELATED APPLICATIONS

This is a continuation-in-part application of copending application Ser. No. 577,148, filed May 13, 1975, now abandoned.

BACKGROUND OF THE INVENTION

The present invention relates to a system for the demand-dependent control of guided vehicles.

A vehicle control system should meet many requirements which present day vehicle control systems satisfy only in part. Essential requirements are the avoidance of damage to the environment (air pullution by exhaust gases, noise), ensuring high passenger convenience (short approach distances to stations, short waiting times, short travelling times),and maximum profitability (low operating and initial cost, high flexibility, fully automatic operation, as far as possible).

SUMMARY OF THE INVENTION

The present invention is mainly concerned with the requirements for high passenger convenience and maximum profitability. In particular, its object is to control vehicle operation according to the demand for transport capacity in such a manner that optimum service and maximum safety are ensured.

A feature of the present invention is the provision of a system for the demand-dependent control of guided vehicles where the equipment necessary of demand registration and control are organized hierarchically comprising: an uppermost hierarchy level including an operations control center, and a plurality of station equipment each coupled to the operations control center by a two-way communication path, the operations control center initiating commands in accordance with destination demands at each of the plurality of station equipment; an intermediate hierarchy level including at least one command and control center coupled to associated ones of the plurality of station equipment by a two-way communication path and coupled to the operations control center by a two-way communication path, the command and control center checks commands received from the operations control center and the associated ones of the plurality of station equipment giving special consideration to safety criteria; and a last hierarchy level including a plurality of vehicles coupled to the command and control center by a two-way communication way to perform the requested tasks in commands received from the command and control center and continuously exchanges information with the command and control center.

BRIEF DESCRIPTION OF THE DRAWING

Above-mentioned and other features and objects of this invention will become more apparent by reference to the following description taken in conjunction with the accompanying drawing, in which:

FIGS. 20A and 20B when organized as illustrated in FIG. 20C is a logic flow diagram of the vehicle command processing of FIG. 18;

DESCRIPTION OF THE PREFERRED EMBODIMENT

Figure 1:
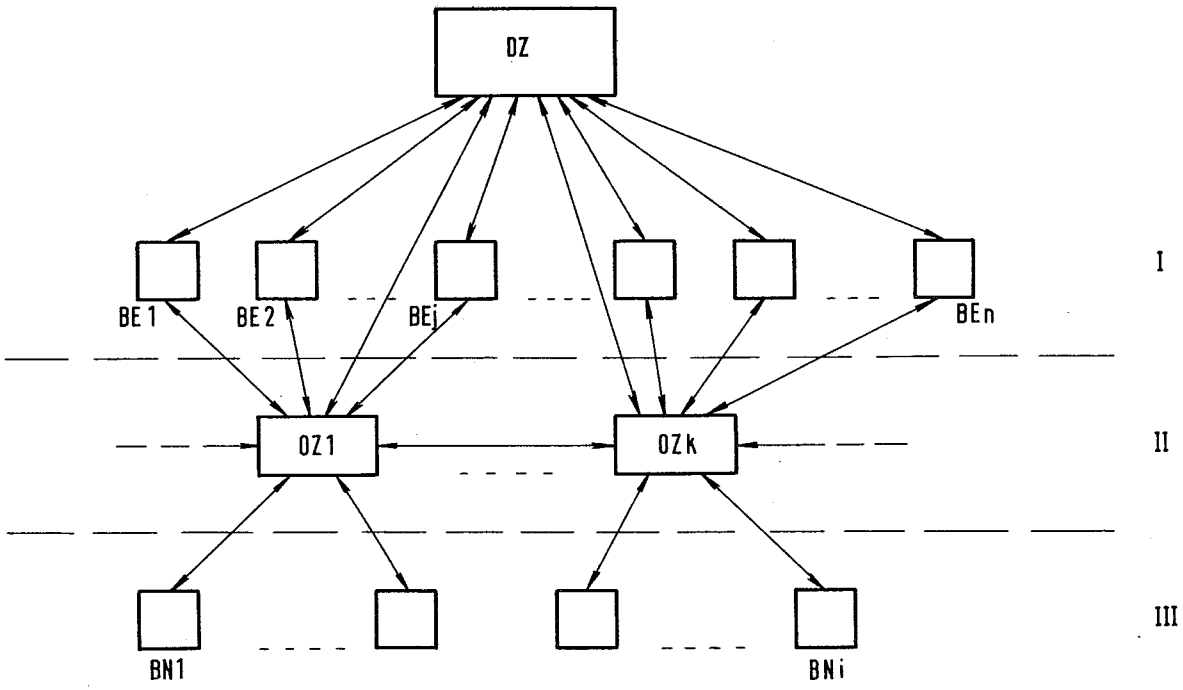
FIG. 1 is a block diagram showing the three hierarchy levels I, II and III illustrating the different responsibilities and tasks within the overall control system in accordance with the principles of the present invention.

Referring to FIG. 1 the uppermost hierarchy level I relates to operations control, i.e. the conversion of passenger requests into running commands to suitable vehicles. Moreover, all information on the respective status of the system is gathered there and taken into account in the assignment of vehicles.

The next hierarchy level II is the command and control level, i.e. it serves to directly control the operations determined in the hierarchy level I, e.g. vehicle assignment. In particular, it is checked at this level to what extent the operations determined at the uppermost hierarchy level are compatible with predetermined safety criteria; thus, this is where the responsibility for the exclusion of any safety risk lies.

The lowermost hierarchy level III contains the system's actual operating facilities, particularly the vehicles.

The hierarchy levels continuously exchange data on the respective operating conditions, e.g. passenger destination requests, fault reports, nominal data, feedback, etc.

According to the invention, the tasks to be performed at the hierarchy levels are distributed among different functional modules, i.e., the functional specialization at the hierarchy levels permits a modular system concept with the resulting advantages, such as optimum adaptation of a system module to the tasks to be performed, no total breakdown of the system in case of the failure of one module, and high flexibility thanks to simple alteration and expansion of the system.

In the following, the functional modules of the individual hierarchy levels and their functions will be described.

The function assigned to the hierarchy level I is essentially performed by an operations control center DZ, which receives the passenger requests from station equipment BEl...BEn. To this end, the station equipment BEl...BEn are equipped with input devices into which each passenger enters his destination. In response to the destination requests, the operations control center DZ determines the general operations control for the overall system, without bearing any safety responsibility, however. General operations control includes, for example, determination of regular intervals between vehicles, vehicle administration, determination of routes, vehicle assignment, and compiling statistics.

The hierarchy level II consists of one or more command and control centers OZl...OZK, which are connected to station equipment, e.g. BEl...BEj, and to the operations control center DZ. It is possible to provide only one command and control center which controls the entire network; when the network is expanded, i.e. by the construction of additional stations with associated equipment, these new stations may be alloted a further command and control center, etc. This already shows the flexibility achieved by the modular design of the system.

The command and control center control actual vehicle operation on the guideway and bear responsibility for signalling safety, i.e., they determine all running commands for the individual vehicles. In so doing, they take into account the information on basic system control, communicated by the operations control center DZ, in order to ensure smooth overall operation.

The functions of the command and control center are, for example:

maintaining safe distance between vehicles;
control of running speed;
control of stopping and emergency brakes;
processing of vehicle-location messages;
supervision of branching and merging operations;
performing coupling operations;
checking vehicle condition, and
evaluation of alarms.

The operating facilities of the hierarchy level III are formed mainly by the vehicles. The vehicles contain a control unit which is capable of evaluating the control commands communicated from a command and control center. In the reverse direction of transmission, such a control unit compiles telegrams for the command and control centers, which telegrams describe the state of the vehicle or train and specify its location and speed.

In the following, the functions and the cooperation of the above-described equipment will be described with the aid of a practical example.

The passenger enters the station. Via a turnstile, which is connected to a destination keyboard, he communicates to the system his destination request. The station equipment accepts this request and transfers it to the operations control center DZ. The operations control center arranges for a vehicle to be made available for the passenger. In the schedule mode, this necessitates no special measures, because the vehicle stops automatically at each station. In the on-demand mode, a vehicle either is available at the station or will be made available as soon as possible.

At the station, the station equipment, as soon as possible, sets destination indicators from which the passenger can see where "his" vehicle will stop. For each platform, the first two arriving vehicles are indicated. At the same time, all destinations of the vehicles due to arrive within the next few minutes are indicated on a panel.

The mode in which the overall system is operated is clearly indicated on the panel and at the station entrance.

A vehicle usually enters the station and stops. If the vehicle has stopped at the correct bay-gate, the command and control center causes the vehicle door and the bay-gate to be opened.

For on-demand service, a button is additionally provided at the platform which button permits the bay-gate door and the door of a vehicle parked at the station to be opened via the station equipment. The operations control center DZ ensures that at no time more than two vehicles are parked at the station.

After four seconds, the control unit of the vehicle initiates a first attempt to close the vehicle door. If the passengers are still leaving/boarding, the door will be kept open. Only after the closing of the vehicle doors are the bay-gates closed. Due to the short distance between vehicle door and bay-gate, a person cannot stay therebetween; thus, when the bay-gate has been closed, the vehicle can depart without any risk for the passengers. The departure of the vehicle is now initiated by the command and control center.

The movement of the vehicle is controlled by the command and control center.

Within the vehicle, the passenger's safety is ensured by constant monitoring of critical parameters, e.g. fire, motor temperature, etc. Opening of the emergency exit after an emergency stop leads to automatic disconnection of the current supply on the guideway.

The passenger can desire from the vehicle a stop at the next station.

Via a two-way communication system, a passenger can communicate to a central operator messages on emergencies in the vehicle as well as information on vehicle disturbances.

In the vehicles, the central operator can make general announcements. Aside from the planned visual indication "car stops," provision for automatic spoken announcements may be made.

Each vehicle on the guideway is monitored and controlled from a central point. The vehicles follow each other at least at the minimum braking distance. To make this possible, information is continuously exchanged between the vehicle and command and control center. In the command and control center, a vehicle telegram is compiled with the safety required in railway signalling systems. To this end, at least two computers calculate the same vehicle telegram with separate programmes. If the calculated results agree, the telegram is transmitted to a vehicle. The information is fed, via a remote supply unit, into a continuous conductor laid along the guideway. The telegram is received by the vehicle addressed with its number, and then checked for transmission errors. This is possible by the use of special transmission codes. The vehicle telegram is then decoded. The telegram contains all important running data for the vehicle; e.g. normal speed, distance to the desired stopping point, emergency-braking steps or retardation, and others. Moreover, coupling commands, control commands for the linear motor, for the supporting and guidance system, for the vehicle switches, etc. are transmitted. the execution of these running/control commands is monitored centrally on the vehicle by the control unit.

In the reply telegram to the command and control centers, all control commands are acknowledged and the location and the nominal speed of the vehicle are signalled back. In case of trouble in important parts on the vehicle, the control unit takes the necessary steps. Each fault report of a vehicle is communicated to the command and control center.

At least every 0.84 sec., each vehicle receives from the command and control center a telegram, which is answered about 70 msec later. A virtually continuous exchange of data takes place.

If a telegram is falsified, this will not result in a situation constituting an operational hazard, because the vehicle still knows its last desired stopping point. To the following vehicle, therefore, it looks as if the vehicle ahead had stopped.

In spite of the false telegram, the vehicle first travels on at the same speed. If the distance to the vehicle ahead has become so small that the braking parabola to the desired stopping point has been reached, the vehicle will be braked. As soon as a telegram with new running data is received which says that the vehicle ahead has changed its location, normal operation will be resumed.

If the command and control center receives no reply telegram from a vehicle, it assumes that the vehicle has not changed its location. As a result, the following vehicles are braked. If the command and control center receives further reply telegrams from the vehicle, normal operation will be continued in this case, too.

The vehicle's reply telegram is fed into the track conductor and transmitted via the remote supply unit to the command and control center. On this data transmission path, too, code protection against falsification of the reply is provided for. In the command and control center, this information is used to compile the telegram for the following vehicle.

Besides the control of minimum vehicle separation, the following operations must be performed with a safety as required in railway signalling systems:

merging a vehicle from a station into a main line, and train formation with end-of-train supervision.

For the merging to two vehicle streams, the command and control center bears the full safety responsibility. By "mirroring" the two vehicle streams together and issuing a running command to a vehicle at the proper time, the command and control center ensures that the two vehicle streams are merged smoothly. Critical situations are avoided by setting a stopping point for one of the two vehicles at the beginning of the switch.

1. BASIC EQUIPMENT (FIG. 2)

Figure 2:
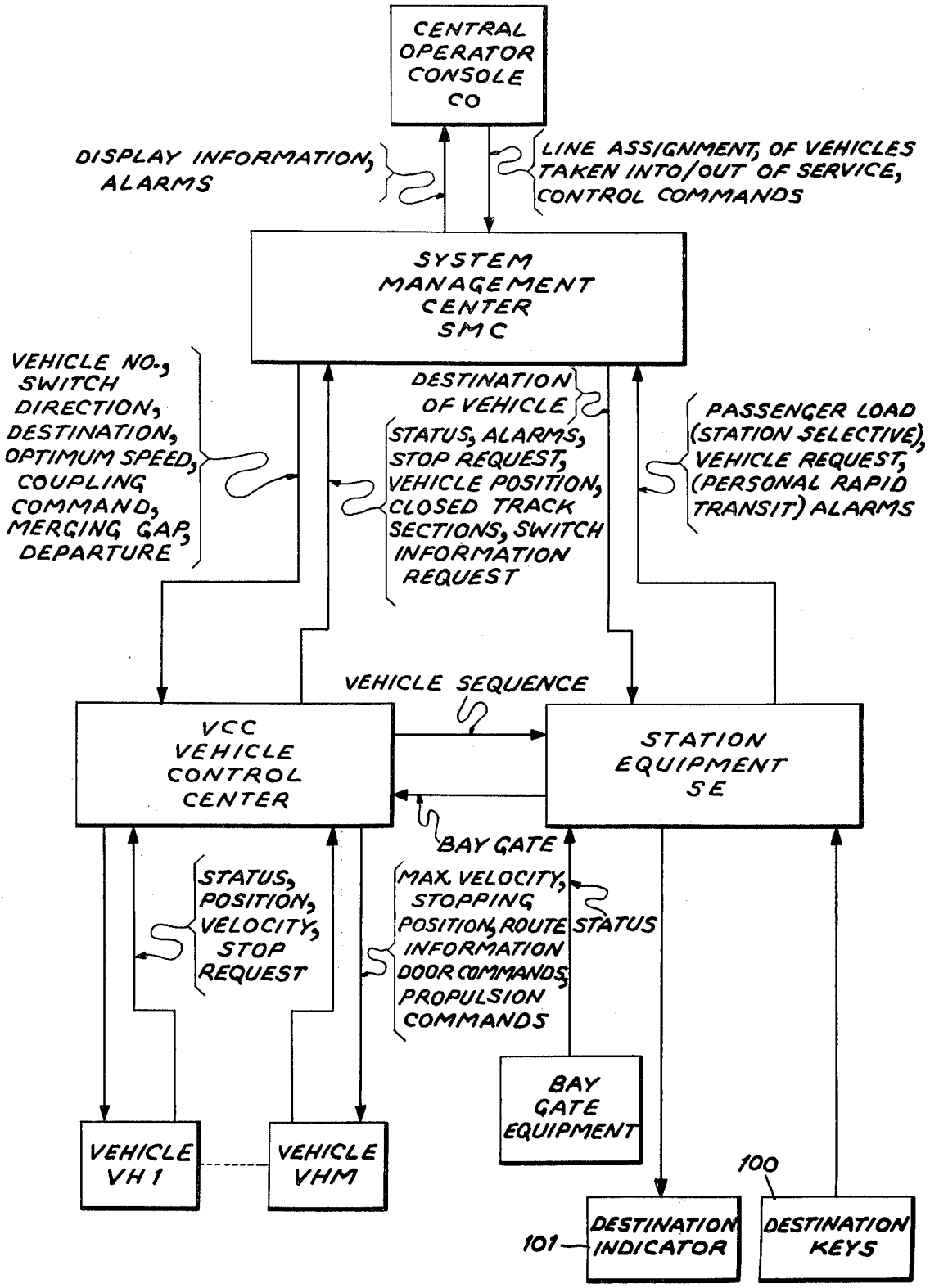
FIG. 2 is a block diagram and information flow diagram of a vehicle control system in accordance with the principles of the present invention.

FIG. 2 is a block diagram of the major components of the control system in accordance with the principles of the present invention with the flow of information between the various blocks thereof being indicated on the drawing. The control system includes a central operator console CO, a system management center SMC, station equipment SE, vehicle control center VCC, and a plurality of vehicles VHl - VHM. Associated with the station equipment SE are destination keys 100, a destination indicator 101 and bay-gate equipment to indicate the status of the bay-gate. As employed herein a bay is an allocated stopping position for a vehicle in a station for the primary purpose of enabling passengers to leave and board and a bay-gate separates the vehicle from the platform.

Station equipment SE communicates with the system management center SMC and the vehicle control center VCC via radio data links or the like. Also system management center SMC and vehicle control center VCC communicate with each other over a similar data link. The vehicle control center VCC communicates with the vehicles via an inductive loop, the details of which will be explained hereinbelow.

Data communication between the vehicles VH and the vehicle control center VCC includes control and status data transmitted to, and data received from, the vehicles via a system of inductive loops laid along the guideway track. The inductive loop signals are exchanged with the VCC computer system via standard data modems. The details of the data system used is as follows: (a) asynchronous two-way communication via loops inductively coupled to antennas on board the vehciles; (b) transmission and reception at the VCC on standard modems; (c) a data rate of 1200 Bd (baud) to the vehicle and 600 Bd from the vehicle; (d) an inductive loop laid along the guideway track under the vehicle's antenna; and (e) data transfer accuracy protected by included redundancy bits and redundancy checking as known.

The vehicle on-board control (VOBC) equipment performs the following main functions: (a) data communication with the VCC; (b) control of the vehicle on the guideway; (c) branching and merging the vehicle to another guideway (switching); (d) stopping at and departing from stations; (e) controlling vehicle door and bay-gate operation at station stops; (f) control in train operation; (g) monitoring vehicle status; (h) passing on passenger requests and providing visual indications to passengers; and (j) voice communications for passengers except where UHF (ultra high frequency) link is installed.

The equipment performs the control functions within the constraints imposed by passenger safety and comfort. The equipment and the functions of (a) through (e) are designed to be fail-safe using current "state-of-the-art" techniques and components.

The design concept and operation of the VOBC requires that only a comparatively small quanity of data need be exchanged between the VOBC and VCC to perform the functions listed hereinabove. The VOBC is able to control important vehicle parameters and to compute appropriate control information from the received data. From this it follows that although the VCC has the overall responsibility for system safety, each VOBC is responsible for safety in controlling some specific functions for its own vehicle. These functions are mainly concerned with the safe movement of the vehicle along successive guideway stretches, whereas it is one of the safety responsibilities of the VCC to ensure, for instance, that the prescribed separation of the vehicles is maintained along these guideway stretches.

The VCC communicates with each vehicle in the system via the inductive loop. Every 70 ms (milliseconds) the VCC addresses one of the vehicles on each inductive loop. In successive 70 ms intervals the VCC addresses each vehicle on a loop in sequence. After the last vehicle on a loop has been addressed, the VCC returns to address the first vehicle. In this way a cyclic communication is maintained with each vehicle. A vehicle will therefore receive a telegram at intervals which are multiples of 70 ms. The intervals depend on the number of vehicles on the same inductive loop and whether the vehicle receives a telegram with detected errors. If only one vehicle is on the loop, the interval will be 210 ms.

Each telegram from the VCC comprises 83.5 bits. The first 5.5 bits are for synchronizing the VOBC to the telegram to enable further processing of the telegram. Asynchronous communication between vehicles and the VCC is therefore ensured since a vehicle replies to each detected error-free telegram addressed to itself, approximately 2 ms after the end of the received telegram.

The data link between the VCC and vehicles is not fail-safe because of the probability of transmission errors. To reduce the probability of undetected errors, redundancy bits, including an error-detection code, are added to the information part of the telegram before transmission from the VCC. The VCC checks for correct redundancy and only accepts the telegram if this is correct. If the redundancy check detects an error, the telegram is ignored by the VOBC.

The VOBC checks the vehicle identity code bits (address) in each detected error-free telegram. If the identity code corresponds to the vehicle's own identity, the VOBC accepts the acts on the information in the telegram. If the identity code does not correspond, the VOBC accepts only the inductive loop identity information.

The control system design allows each vehicle to compute and command its own velocity (in small increments) based on the vehicle's position and on data received from the VCC. The reduction in data exchange follows since the VCC updates and transmits the braking parabola number, maximum velocity (for the particular guideway section), end velocity and stopping position. In return, the VCC receives the vehicle's actual velocity and position in coarser steps to enable the VCC to perform its control functions and to make a plausibility check.

The vehicle's physical position in the system is determined from three sources: (a) the inductive loop over which the vehicle is travelling (loop identity); (b) coarse position measurement (CPM) which is a subdivision of the inductive loop length; and (c) precise position measurement (FPM), which is a subdivision of a coarse position.

Each vehicle obtains the identity of the inductive loop over which it is travelling from each detected error-free telegram from the VCC. Since each vehicle replies to an addressed telegram, the system via the SMC and VCC confirms which vehicles are on the different loops. The system is aware of which vehicles should be on the different inductive loops from data accumulated since system start-up. The VOBC uses only a change in loop identity to define the guideway coordinate system.

Inductive loops have "crossovers" approxaimtely every 6.7 m (meters). An inductive loop may have up to 256 crossovers. Equipment on board the vehicle detects each crossover (coarse position measurement). The FPM system detects "marks" on a guideway "grid." There are 64 "marks" between each crossover. The FPM marks and crossovers are counted by the vehicle equipment and registered in the VOBC in precise position increments, "half-crossover" length increments and crossovers. The "half-crossover" position (maximum 511 increments) is reported to the VCC, whereas the precise position is used only by the VOBC. In addition, the VOBC calculates the vehicle's actual velocity from the precise position count.

One of the requirements for a safe co-ordinated operation between the VOBC and the VCC is a correlation between the system of co-ordinates. Both parts of the system must understand the commands "forward," "back," "left," "right," "front" and "rear" in relation to travel direction, couplers, vehicle doors and switching system operation. Although the vehicle is designed for symmetrical operation (sensors, antennas, doors, etc.) and may be placed either way around on the guideway, the VOBC defines the vehicle's front and rear (hence left and right) from the physical construction of the vehicle. This gives the "vehicle co-ordinate" system. It should be noted that there is not visual difference between either end of the vehicle.

The guideway co-ordinate system is based on the "half-crossover" count direction. This is known by the VCC from that center's stored system data, and is deduced by a VOBC from a change in loop identity. In each telegram the VOBC receives the loop identity. If the identity changes, the VOBC deduces which is the shortest mathematical direction from the old identity to the new identity. If the shorest mathematical direction is "clockwise," the "half-crossover" register is set to 0 and the VOBC begins to count "up" from 0 to 511. If the shortest mathematical direction is "counter-clockwise" the VOBC counts "down" from 511 to 0.

In practice, the change of loop identity information may arise after the vehicle has passed the loop change and has traversed a few crossovers. To allow for this, an auxiliary register is set to 0 at the loop change position by a signal from a guideway marker. This register counts the crossovers that the vehicle may pass over before the VOBC deduces the loop change information. The content of the auxiliary register is applied to the "half-crossover" counter when the count direction is set by the VOBC. The VCC is informed of the deduced count direction.

Actual travel direction in vehicle co-ordinates is deduced by the FPM system and therefore the VOBC can correlate count direction with travel direction. Commands from the VCC to the vehicles are given in guideway co-ordinates (count direction) and each vehicle converts the data to its own co-ordinate system using the correlation data. In this way, the VCC need only address direction in relation to the guideway and does not have to be aware of the vehicle's defined front and rear. Thus "front" to the VCC means the leading end of the vehicle in the direction in which the vehicle entered the loop. It follows therefore, the at the vehicle can be commanded to travel "count up" or "count down" in the guideway direction count up (defined at Loop entry), or to travel "count down" or "count up" in the guideway co-ordinate direction count down (from loop entry).

The data from the VCC to vehicles is sent in serial form at 1200 Bd, 83.5 bits are sent in one 70 ms VCC process cycle. The format of this serial information is as follows: (a) bits 1 – 5 (5.5) synchronous code with bit 3 equal to 1.5 bits; (b) 6 – 8 (3) start bit and Barker code; (c) bits 9 – 75 (67) information; and (d) 76 – 83 (8) redundancy bits. The following TABLE I describes the information in order transmitted from the VCC to the vehicles.

TABLE I

Information Bits VCC ⟶ VH

| Byte, Bit & Sequence | Signal Mnemonic | Signal Description | Code ls...ms |
|---|---|---|---|
| 09–11 | BK | Inductive Loop Indentification: | |
| | | A2 | 000 |
| | | a | 001 |
| | | b | 010 |
| | | c | 011 |
| | | d | 100 |
| | | e | 101 |
| | | (not used) * | 110 |
| | | A1 | 111 |
| | | Note: A1: Preset loop code indicating count up for the consecutive loop. A2: Preset loop code indicating count down for the consecutive loop. | |
| 12–13 | KN | Vehicle number (0 ⟶ 1023) (Highest 2 Significant bits of 10 bit code) | |
| 14–21 | KN | Vehicle number (0 ⟶ 1023) (8 least significant bits, bit 14 ls.) | |
| 22 | KUH | Rear Coupler: | |
| | | activate | 1 |
| | | de-activate | 0 |
| 23 | KUV | Front Coupler: | |
| | | activate | 1 |
| | | de-activate | 0 |
| 24–27 | LN | Line number 0–15 | |
| 28–29 | T | Door Opening Command: | |
| | | Do not open doors | 00 |
| | | Open right doors | 01 |
| | | Open left doors | 10 |
| | | Open right and left doors | 11 |
| 30 | ZR | Travel instruction: | |
| | | travel into the up-count direction | 0 |
| | | travel into the down-count direction | 1 |
| 31–37 | VM | Vehicle maximum velocity (km/h) 0, 1.6,--------,203.2 | |
| 38 | SQ | Failure Acknowledgement | |
| | | no | 0 |
| | | yes 1 | |
| 39 | WB | Switching data register unlocking: | |
| | | unlock register | 0 |
| | | lock register | 1 |
| 40–43 | FW | Command direction for the next 4 successive switches: (bit 40 next, bit 43 4th) | |
| | | left | |
| | | right | 1 |
| 44–45 | ZP | Stopping Position (2 most significant bits of 10, 128f, 256f). | |
| 46–53 | ZP | Stopping position (8 least significant bits, f/2 ⟶ 64f; f=distance between two crossovers of the inductive loop; ≈6.7m) | |
| 54 | H | Display VEHICLES STOPS AT NEXT STATION: | |
| | | off | 0 |
| | | on | 1 |
| 55 | TFS | Support and guidance system on/off switch: | |
| 56 | M | Linear motor on/off switch: | |
| | | off | 0 |
| 57 | EHS | Power supply on/off switch: | |
| | | on | 1 |
| 58–59 | AKU | Voice Communication | |
| | | mike off/speaker off | 00 |
| | | mike off/speaker on | 01 |
| | | mike on/speaker off | 10 |
| | | - not used - | 11 |
| 60 | AP | Vehicle state: | |
| | | Vehicle active | 0 |
| | | Vehicle passive | 1 |
| 61 | ZSCH | End-of-train signal: | |
| | | on | 0 |
| | | off | 1 |
| 62 | KE | Reply Telegram type: | |
| | | type 1 | 0 |
| | | type 2 | 1 |
| 63–69 | VZ | End velocity (km/h) 0, 1.6, 203.2 (bit 63 least significant bit). | Dual |
| 70 | NB | Activate Emergency Brake: | |
| | | no status change | 0 |
| | | activate brake | 1 |
| 71 | NBL | De-activate Emergency Brake: | |
| | | no status change | 0 |
| | | de-activate brake | 1 |
| 72 | KR | Creep command: | |
| | | do not creep | 0 |
| | | creep | 1 |
| 73–75 | BKN | Number of braking parabola: | |
| | | 8/8 a | 000 |
| | | 7/8 a | 001 |
| | | 6/8 a | 010 |
| | | ↓ | ↓ |
| | | 2/8 a | 2/8 a |
| | | 1/8 a | 111 |

Information from the vehicle VOBC to the VCC is at a rate of 600 Bd. The format structure is as follows: (a) bits 1 – 5 (5) synchronization and start bits; (b) bits 6 – 34 (29) information bits; and (c) bits 35 – 41 (7) redundancy bits. TABLE II sets forth the information in the order transmitted from the vehicle VOBC to the VCC.

TABLE II

Information Bits VH ⟶ VCC

| Byte. Bit & Sequence | Signal Mnemonic | Signal Description | Code |
|---|---|---|---|
| 6 | KE | Telegram type: | |
| | | type 1 | 0 |
| | | type 2 | 1 |
| 7 | MM | Manual mode indicator: | |
| | | Vehicle under manual operation | 1 |
| | | Vehicle under automatic operation | 0 |
| 8 | BH | Stop next station: | |
| | | no request | 0 |
| | | request | 1 |
| 9 | TZ | Door Status: | |
| | | closed | 0 |
| | | open | 1 |
| 10–11 | WBU | Switch Back-up: (guideway co-ordinates) | |
| | | Failure | 00 |
| | | to the right | 01 |

TABLE II-continued

| Byte. Bit & Sequence | Signal Mnemonic | Signal Description | Code |
|---|---|---|---|
| | | Information Bits VH ⟶ VCC | |
| | | to the left | 10 |
| | | Failure | 11 |
| 12 | AKU | Speaking demand: | |
| | | no demand | 0 |
| | | demand | 1 |
| 13–17 | ST | Failures: | |
| | | No failure. | 00000 |
| | | Fire. | 00001 |
| | | Hydraulic total breakdown. | 00010 |
| | | Velocity measurement failure. | 00011 |
| | | Hydraulic & support and guidance system partial break-down. | 00100 |
| | | Support & guidance system & 600v total break-down. | 00101 |
| | | Propulsion system partial break-down. | 00110 |
| | | Propulsion system total break-down. | 00111 |
| | | Vehicle out of permitted temp. range. | 01000 |
| | | PPM failure. | 01001 |
| | | CPM failure. | 01010 |
| | | Vehicle overspeed. | 01011 |
| | | Perm. non-equiv. failure. | 01100 |
| | | Passenger activated emergency brake. | 01101 |
| | | Passenger activated station stop. | 01110 |
| | | Emergency exit opening. | 01111 |
| | | Emergency activation contact failure. | 10000 |
| | | Guideway signal receiver failure. | 10001 |
| | | Bay-gate failure. | 10010 |
| 18 | FRQ | Travel direction acknowledgement: | |
| | | down | 1 |
| | | up | 0 |
| 19 | FN | Vehicle position (most significant bit of 9) | |
| 20–27 | FN | Vehicle position in steps of f/2 (f= distance between two crossovers; ≃ 6.7m) bit 27 least significant. | dual |
| 28–34 | VIST | Actual velocity in steps of 1.6 km/h; maximum 203.2 km/h.; bit 34 least significant. | |

2. STATION EQUIPMENT, GUIDEWAY AND VEHICLE (FIGS. 3 – 11)

Figure 3:
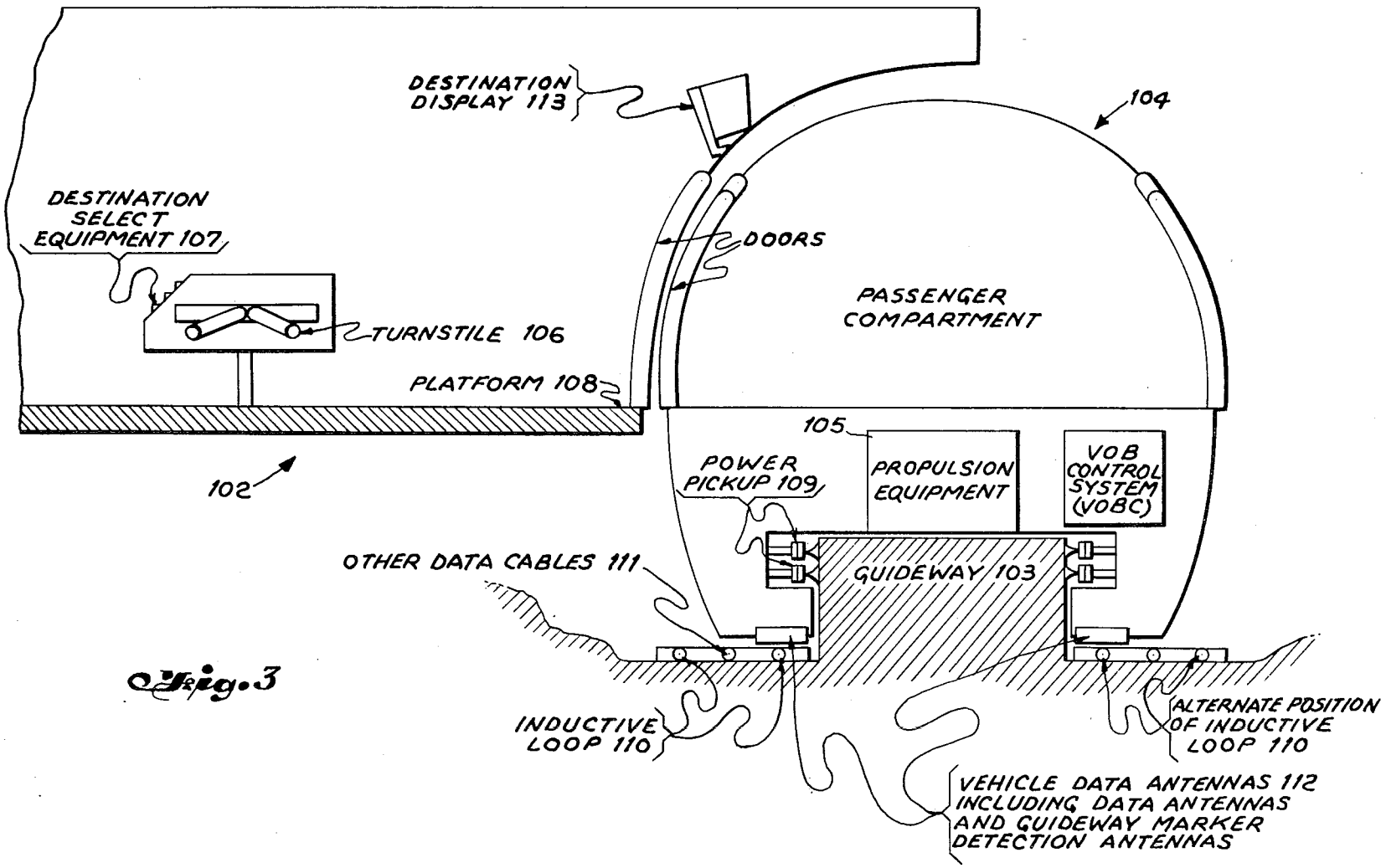
FIG. 3 is a schematic representation of vehicle and passenger control equipment at a stopping point.

FIG. 3 illustrates the station equipment 102, the guideway 103 and the vehicle 104. The invention is independent of the type of vehicle as long as the vehicle is able to carry the system antennas and VOBC equipment. The vehicles may be of the following types, but they are not limited to these types. Suspension may be by magnetic levitation; air cushion; rubber tires on track; and steel wheels on steel track. The propulsion equipment 105 may be a linear induction motor; a DC (direct current) motor geared to axle; an AC (alternating current) motor geared to axle; diesel; and a diesel, generator and electric motor. The size of the vehicle 104 should for the sake of efficiency have space for a minimum of six passengers with a maximum size limited only be structure of the guideway track and station. The turnstile 106 may have associated therewith the destination select equipment 107 which is the principle destination requested input device and the control for the passenger flow to the platform 108.

At the concourse end a group of annotated pushbuttons or a ticket reading device accepts the passengers destination request. Operation of the destination select equipment 107 request the system to unlock the turnstile. The turnstile arm only opens in the inward direction. An exit turnstile comprises an outward-opening-only arm, to enable passengers to leave the platform. The input turnstile can be mechanically unlocked at the turnstile by system personnel in the event of an emergency evacuation. In the case of demand service the passenger operates equipment 107 as soon as he is at turnstile 106 and has decided on his destination. The system then accepts his input and unlocks the arm (if the platform is not full). The waiting time interval is a system parameter as discussed hereinabove under subsection C. For schedule service the passenger produces the same functions as for demand service. The waiting time is also a system parameter and depends on the length of guideway, number of vehicles, etc.

Guideway track 103 can have most forms of track structure capable of supporting the vehicle and providing the following facilities: (a) means to accept the thrust from vehicle propulsion equipment 105 (e.g. reaction rail or rails for wheels) and able to accept vertical and lateral support thrust; (b) platforms at the stations to permit passengers to board and leave; (c) provision for power pick up rails 109; and (d) provision for cable power pick up troughs 109 for the inductive loops 110 and other system data communication cables 111. The position of the inductive loops is defined in relation to the vehicles data antennas 112.

At the station there is provided a destination display 113 to inform the passengers on platform 108 of the destination of the vehicle now in the station so that the passengers can board if the destination displayed in display 113 is his selected destination.

Figure 4:
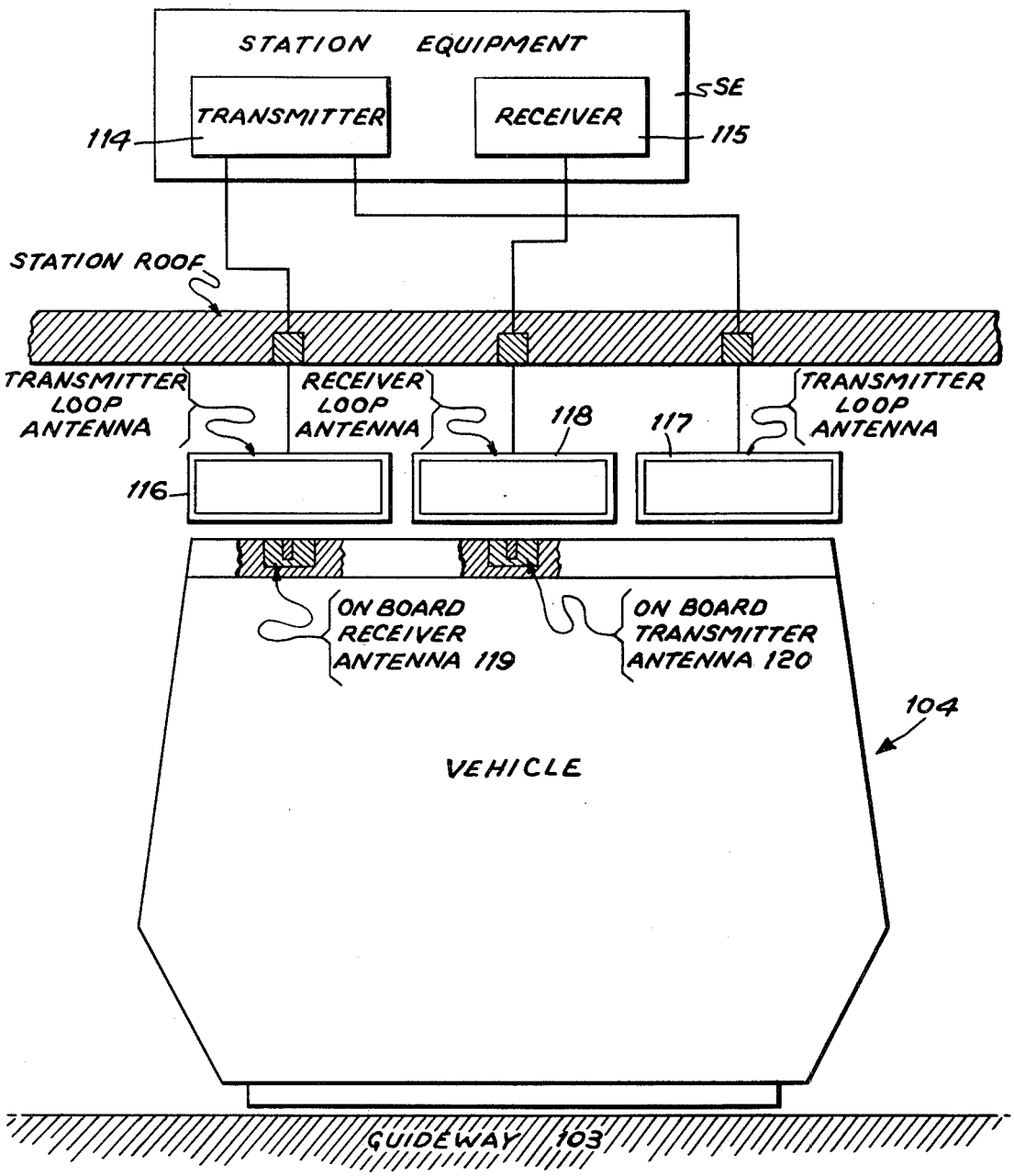
FIG. 4 is a schematic representation of equipment necessary for Bay-gate control.

Referring to FIG. 4 there is illustrated therein additional equipment that may be provided at a station. This additional equipment is for gate control and includes in station equipment SE, transmitter 114 and receiver 115 coupled to transmitter loop antennas 116 and 117 and receive loop antenna 118, respectively. Antennas 116 117 are coupled to on-board receiver antenna 119 and on-board transmitter antenna 120. This equipment is employed for low power local bay-gate and vehicle door control.

The station equipment depends on options required by the customer. In general, the equipment at the station is for passenger guidance such as destination display 113 and passenger control such as turnstile 106 and equipment 107. Data to and from station equipment SE is to and from the system management center SMC via a modem data link. Any information on passenger input-output required by the VCC is obtained from the SMC. If bay-gates are included, this would be considered an interface to the control system of this invention and would be supervised by the VCC via the SMC and use the local control of the bay-gate antennas.

Figure 5:
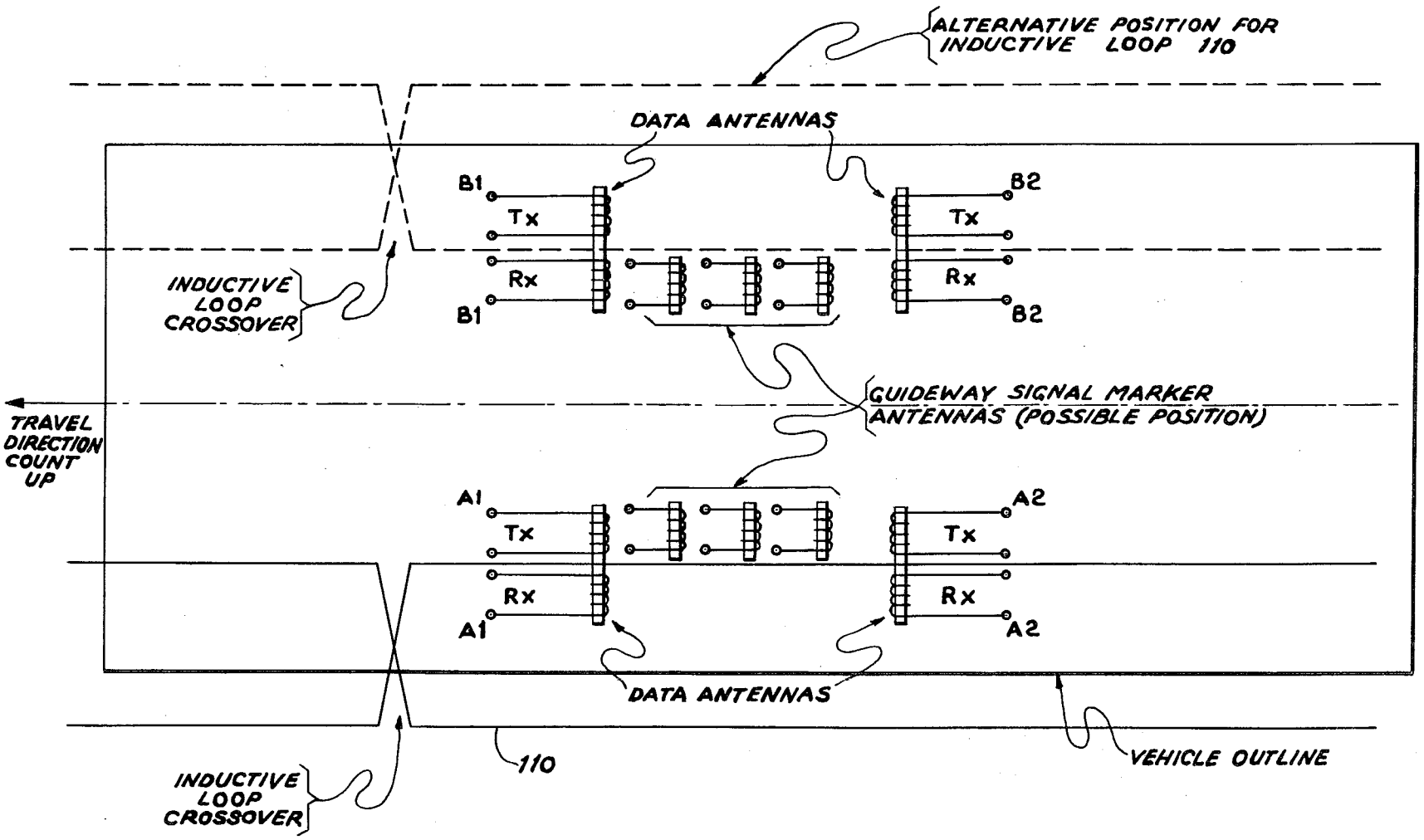
FIG. 5 is a view of the underside of a vehicle illustrating the inductive loop, inductive loop date vehicle antennas and guideway signal marker antennas.
Figure 6:
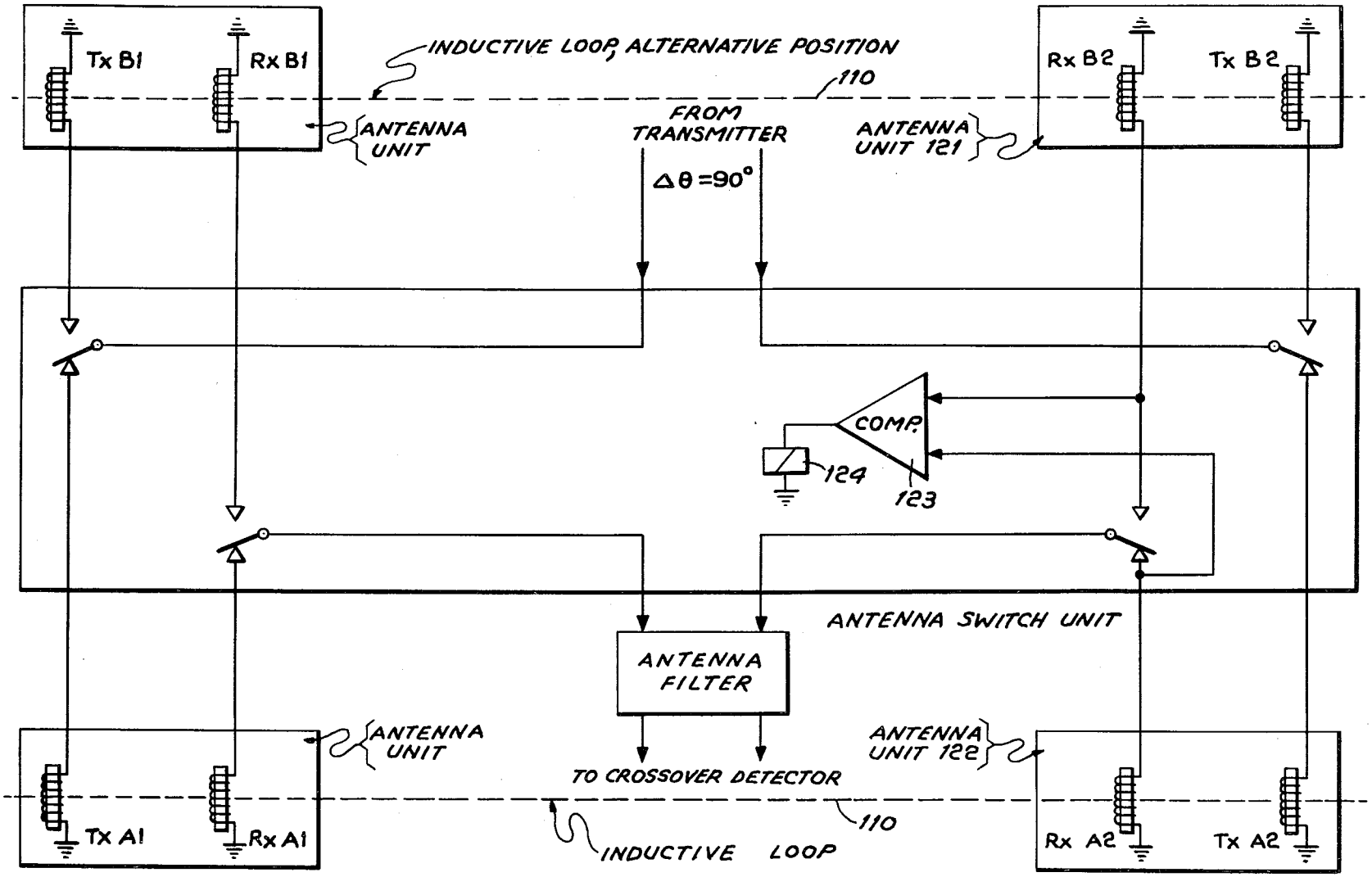
FIG. 6 is a block diagram of a data vehicle antenna switching circuit.
Figure 7:
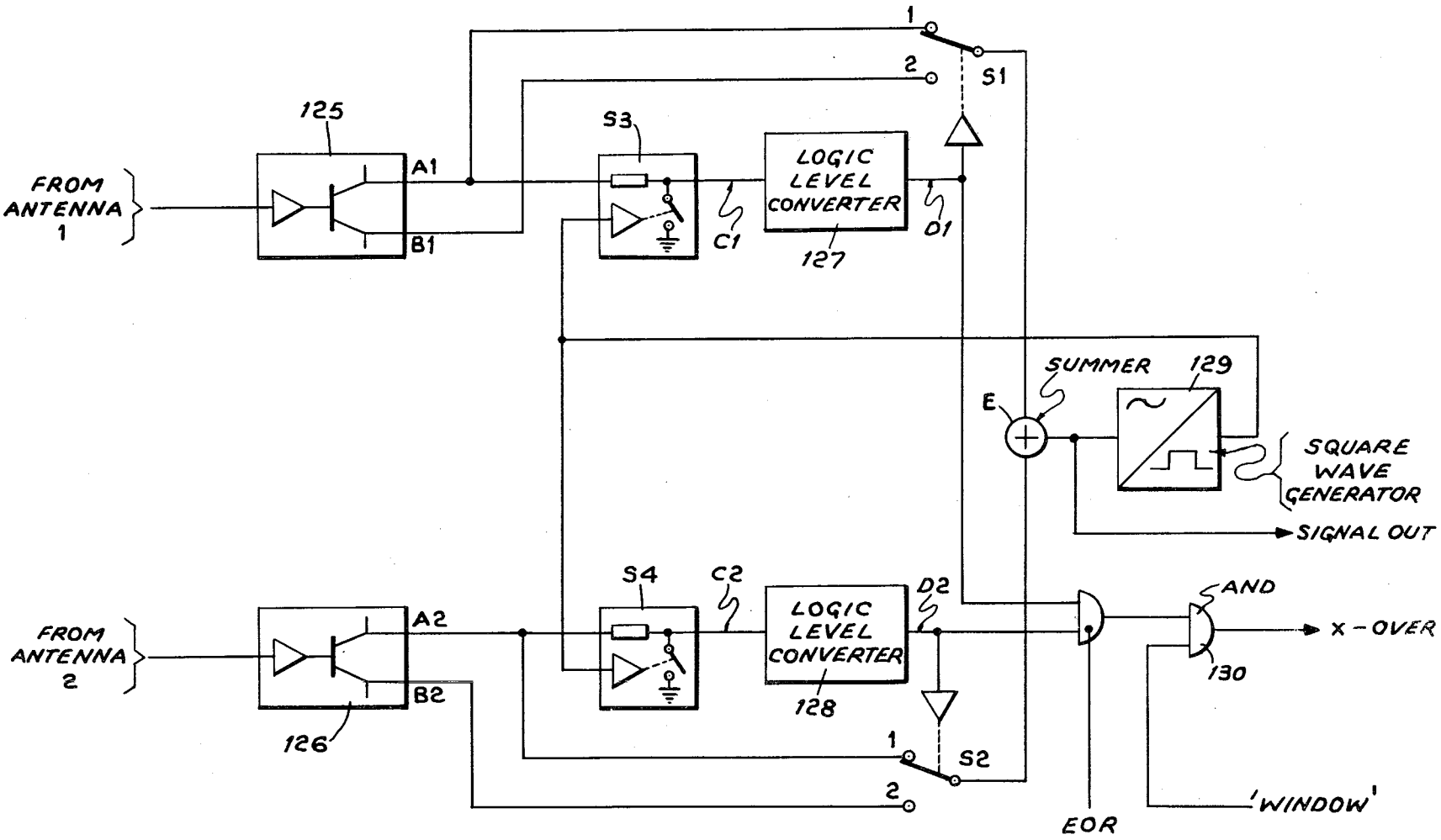
FIG. 7 is a block diagram of the coarse position-inductive loop crossover detector.

As is illustrated in FIG. 3, there is illustrated a "dotted" inductive loop 110 to indicate that the loop 110 may be on either side of guideway 103. This depends on the structure of guideway 103 and the configuration of transport system switches. In some cases there may be short stretches where the inductive loop 110 is on both sides of the guideway 103. FIGS. 5, 6 and 7 illustrate the on-board antenna switching arrangement carried by vehicle 104 to cater for the possibility of loop 110 appearing on one side or the other of guideway 103. The inductive loop 110 may be under the left or right side of vehicle 104. It is, therefore, necessary to switch the operative antennas from the left side to the right side and vice versa according to the position of the inductive loop. As shown in FIG. 5, there are two transmit and receive antenna units associated with each possible position of inductive loop 110. There is also illustrated herein a possible position for guideway signal marker antennas. As seen in FIG. 6, the signal level from one of the left side receive antenna R × B2 of antenna unit 121 is compared to the signal level from the right side receive antenna R × A2 of antenna unit 122. The comparator 123 actuates at least one relay 124 to control the switches illustrated so that the data antenna on the side with the highest received signal levels is the antenna coupled to the crossover detector.

The reason for two receive antennas on each side is explained hereinbelow with reference to the description of the coarse position measurement. The guideway signal antennas are also switched in the antenna unit (now shown). Since the passive guideway signal marker antennas are on the opposite side of the guideway from the inductive loop, the switching of the on-board antennas is in the opposite direction to the data antenna switching.

As mentioned previously, the vehicle's position along the guideway is determined by three data sources: (a) the inductive loop identity and inductive loop changeover marker with the former being received in the telegram from the VCC; (b) the coarse position obtained from the inductive loop crossovers; and (c) the fine position (precise position) from the guideway marker antenna spaced along the guideway approximately each 10.5 cms. (centimeters).

The inductive loop, which is used for data exchange between the VCC and vehicles, has "crossovers" approximately every 6.7 m. The electromagnetic field around the loop from VCC is therefore phase-shifted through 180° at each crossover. Since the receive antennas may be both between the same pair of crossovers or one each on each side of the crossover, the received antenna signal may be in-phase or out-of-phase. From these antenna signals, the crossing detector units senses the change in phase at the crossover and is thus able to provide a coarse position indication to the VOBC. Electronic switching in the unit provides a data signal unit output which is the sum of two in-phase signals irrespective of the phase of the antenna signals.

As illustrated in FIG. 7, signals from the receive antennas are coupled to two amplifiers 125 and 126, each of which have two outputs with a phase difference of 180°. By means of the electronic switches S1 – S4, signals with the same phase are summed together at summer E and outut to the analog part of the data receiver. The possible combinations of signals are, therefore, A1 + A2 or B1 + B2 for antenna signals in phase and A1 + B1 or A2 + B2 for antenna signals out-of-phase. Switches S3 and S4 are electronic switches which effectively rectify the A1 and A2 antenna signals such that if a switch is "closed" during a positive half-cycle of antenna signal A1 (A2) the voltage at C1 (C2) will have a steady-state negative level. If the switches S3 and S4 are "closed" during a negative half-cycle, the level at C1 (C2) will be positive. The logic level converters 127 and 128 outputs a logic 1 for a positive input level and a logic 0 for a negative input level. Switch S1 (S2 will "switch" to position 1 for a logic 1 at point D1 (D2). The generator 129 produces square-waves out-of-phase with the output of summer E. The positive pulse of the square-wave output of generator 129 "closes" switches S3 and S4. If, for example, signal A1 is in phase with signal A2, points C1 and C2 will be positive and switches S1 and S2 will be placed in position 1. The in phase signal at A1 and A2 are, therefore, summed in summer E and will provide the output to the analog part of the receiver. If, now, the antenna voltage changes phase (at a crossover), switch S4 will "close" on the now positive half-cycles of signal A2, point D2 will change to logic 0 and switch S2 will switch to position 2. The in phase signal now summed at summer E are therefore signals A1 and B2. It follows that switch S1 and switch S2 will "switch" over each time there is a change in the phase of one of the antenna voltages.

The change of logic levels at points D1 and D2 is detected in an EXCLUSIVE OR circuit EOR to give a logical output at each crossover. The "window" enable signal is present just before and after the anticipated crossover to reduce the probability of false crossover signals caused by noise. The crossover signal at the output of AND gate 130 is used to preset the FPM counter to a value determined by the VOBC.

Each inductive loop has two identities. One is used by the VCC and the other is transmitted from the VCC to the vehicle for on-board processing. A VCC can handle up to 16 inductive loops with each loop considered as a channel to which the VCC outputs data. The VCC therefore identifies the channels as 0 to 15.

In each telegram transmitted to a loop, a vehicle on that loop receives a 3-bit loop code (see bits 9 – 11 of TABLE I). The VOBC uses the change in loop code (as the vehicle passes from one loop to the next) to establish whether it should count up or down. With up to 16 loops, 5 of the possible identities from the 3 bit-code would be used in a cyclic sequence. The 3 bit code transmitted is deduced by the VCC from the "channel" number.

Figure 8:
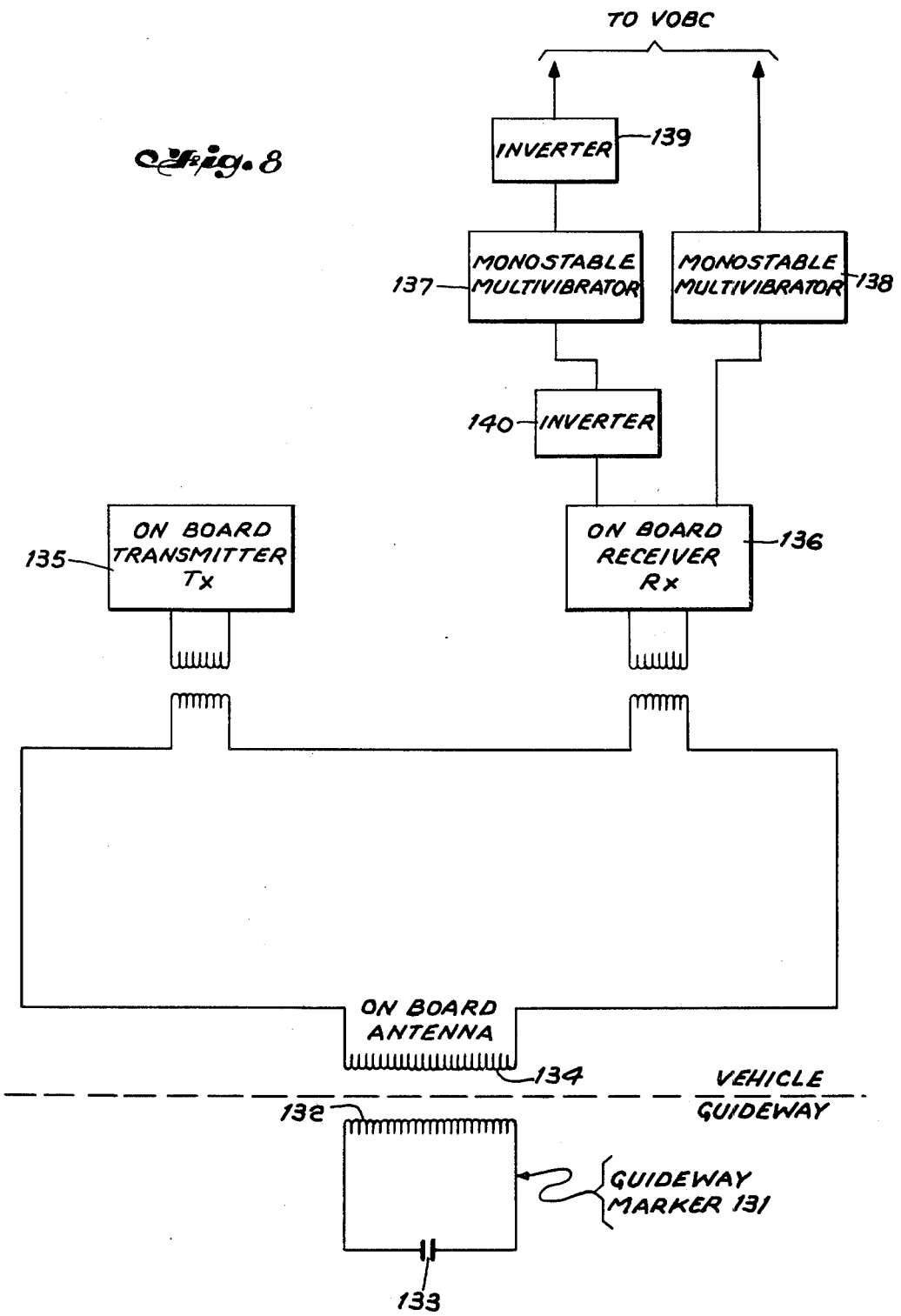
FIG. 8 is a block diagram of guideway signal marker antenna detector.

Three guideway signal modules are installed in the vehicle, one to detect the inductive loop change markers and a second and third to detect the switch zone "begin" and "end" markers. The modules are similar, the difference being in the operating frequency. The arrangement of FIG. 8 shows one of the on-board modules. The guideway marker 131, in each case is a passive tuned circuit. The operating frequencies are as follows: (a) switch zone "begin" 10 KHz; (b) switch zone "end" 12 kHz; and (c) inductive loop change 15 kHz. Guideway markers 131 comprise an antenna coil 132 capacitively tuned by capacitor 133 to one of the above frequencies according to its allocated function. The guideway antenna coil 132 is located in the guideway structure such that the vertical separation between the antenna coil 132 and the passing vehicle antenna 134 is approximately 60 – 70 mm (millimeters).

When a vehicle guideway signal antenna is not in close proximity to the appropriate antenna (or passes over one of the other guideway antennas), the impedance of the on-board antenna 134 is low and, therefore, the transmitter signal from transmitter 135 is input to receiver 136. This input signal is detected and output to monostable multivibrators 137 and 138 as a non-equivalent steady state signal. Inverter 139 at the output of monostable multivibrator 137 provides a non-equivalent output to the VOBC. For instance, monostable multivibrator 137 = logic 0 and monostable multivibrator 138 = logic 1.

If a vehicle guideway signal antenna passes over a marker tuned to the transmitter frequency, the on-board antenna 134 impedance increases sharply while the antennas are coupled. This reduces the level of the transmitter signal to receiver 136. This is detected and the non-equivalent signal pair from receiver 136 changes state. An inverter 140 at the input of monostable multivibrator 137 ensures that both monostable multivibrators 137 and 138 trigger at the same time to output a 100 ms pulse. Inverter 139 ensures a non-equivalent pair, for instance, monostable multivibrator 137 = logic 1 and monostable multivibrator 138 = logic 0.

Figure 9:
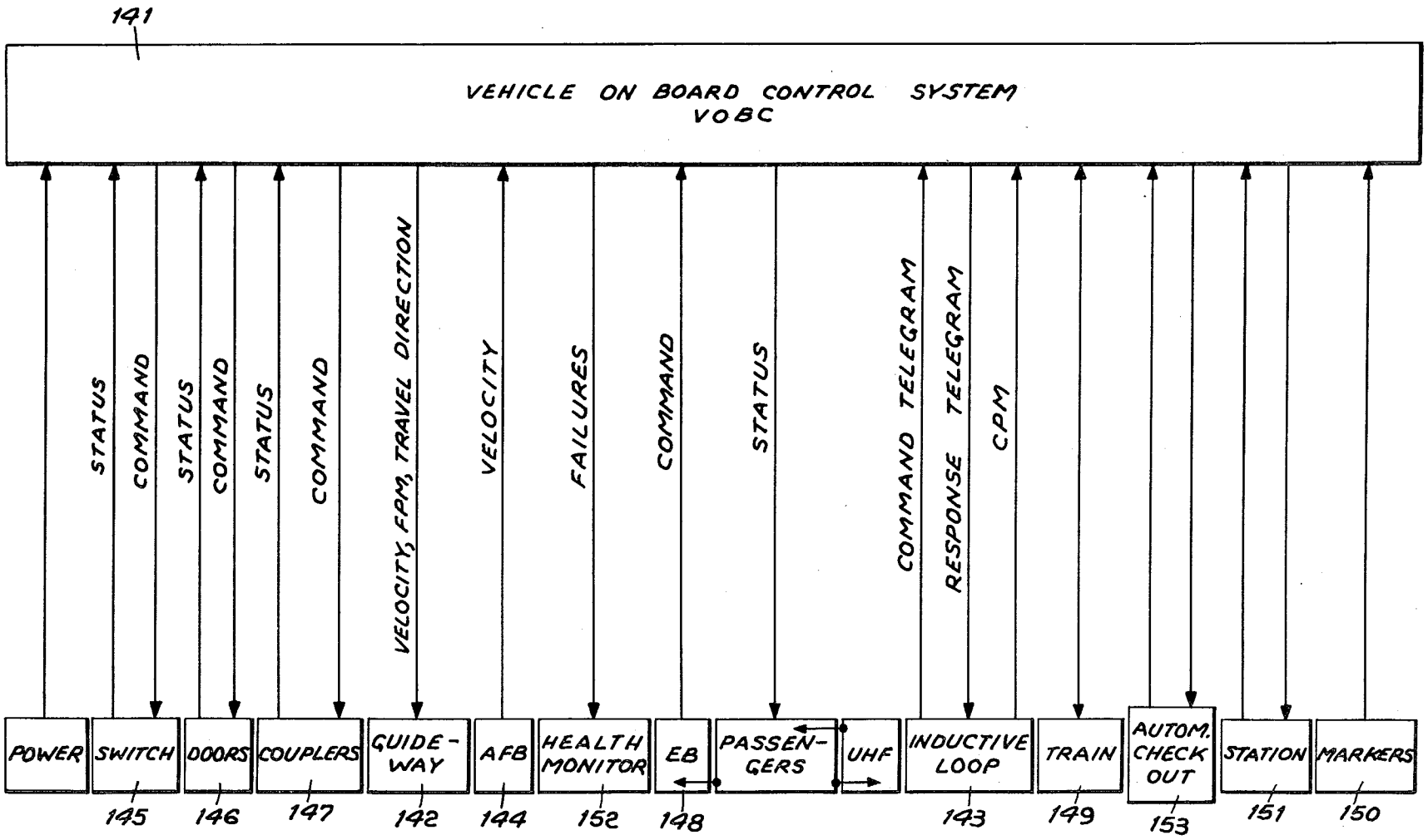
FIG. 9 is a general block diagram of equipment interfacing with the vehicle on board control system.

Referring to FIG. 9, there is illustrated therein the vehicle on-board control system (VOBC) 141 and the peripheral equipment or modules which are interfaced therewith. The modules to which VOBC 141 interface are guideway 142, inductive loop 143, AFB (automatic speed and braking control) 144, on-board switch 145, doors 146, couplers 147, emergency brake valves and passenger emergency brake 148, other VOBC's in the train 149, optional markers 150, stations (optical bay-gates) 151, health monitor 152, and automatic check out equipment 153.

The interface to guideway 142 is for velocity, fine position measurement (FPM) and travel direction detection. Normally this data is derived from two three-phase synchro-generators mounted on an idler axis of the vehicle. Two generators are used for safety reasons.

The interface with inductive loop 143 is in two parts: (a) data channels for communication with VCC, two antennas are used to exchange data with the VCC, using carrier frequencies in the range of 30 – 60 kHz; and (b) coarse position measurement (CPM); the crossover in the inductive loop are recognized by a module which detects phase changes between the two received signals. The phase change detection is interpreted by the VOBC as a coarse position.

The AFB 144 is responsible for keeping the vehicle at the commanded velocity. This information can be output in two ways: (a) as an analog signal whose magnitude is proportional to the commanded velocity; or (b) as a 2-bit signal indicating brake, accelerate or roll.

The VOBC commands the on-board switch 145 position with a 2-bit non-equivalent signal with two defined states (switch left and switch right). The switch status is reported back-with a non-equivalent signal. This signal must be fail-safe, i.e. the signal has a defined state only when the switch is in a defined and locked position.

The doors 146 are controlled with two 2-bit non-equivalent signals which have two defined states, close left (right) door and open left (right) door. The door status is reported back with one 2-bit non-equivalent signal which must be fail-safe. A "closed door" status is reported only when all doors are closed and locked.

The vehicle has independently controlled front and rear couplers 147. Each coupler is commanded with a 1-bit signal which either commands the coupler to be active (coupling possible) or inactive (coupling not possible). The status is reported back as a 1-bit signal from each coupler to indicate if the coupler is in an active or inactive state.

The VOBC should have direct access to two separate magnetically operated valves both having the capability to activate the emergency brakes 148. These valves should be normally energized so that the brakes are applied if the current through one of the valve coils is interrupted. The VOBC can interrupt this current via one or more relay contacts. To release the brakes, the VOBC outputs a 2-bit non-equivalent signal. The emergency brakes will only release on this signal if no condition exists outside the VOBC which inhibits release.

The passenger activated emergency brake handle provides direct application of the emergency brakes. The status of the handle is input to the VOBC as a 1-bit signal. The central operator (CO) is informed of this status via the data communication channel to the VCC.

Markers 150 which may be optional, which are placed along the guideway, may be necessary for certain configurations. For instance, in switch areas markers indicate to the vehicle the beginning and end of this area. The markers are passive and tuned to a specific frequency according to their function as desribed with respect to FIG. 8.

The train 149 is employed in train operation since it is necessary that some information be exchanged between the VOBCs of the individual vehicles via a train internal data-link. Data exchanged includes the supervision of: (a) train length indicating that the train is intact; (b) emergency stops indicating that one of the vehicles has initiated its emergency brakes; (c) departure lock indicating if all vehicles are ready for departure (doors closed, brakes released); and (d) switch status indicating if all vehicles have the correct defined switch status. In addition a "live" signal and "emergency release" signal must be exchanged on the intra-train communication link to inform the other VOBCs in the train that the lead VOBC is functioning normally.

Health monitor 152 monitors specific vehicle parameters (e.g. motor temperature, hydraulic system, etc.) and failure signals are input to the VOBC which reacts to each failure in a defined manner.

If bay-gates are installed at station 151, a communication link between vehicle and bay-gate must exist to guarantee correct and safe door and bay-gate opening. An opening command is transmitted via an inductive coupling from the vehicle to the bay-gate and in the return direction, the bay-gate status is transmitted to the vehicle. (Note FIG. 4).

A facility is provided for the connection of external check-out equipment 153 to the VOBC. The check-out equipment simulates guideway and vehicle equipment so that the VOBC may be tested independently from the rest of the vehicle and guideway.

Each of the VOBC peripherals is designed so that externally generated signals can be used to exercise the VOBC instead of the actual derived signals. For example, CPM and FPM data can be generated by the automatic check-out equipment in response to VOBC commands to simulate vehicle movement. Telegrams can be issued, and the check-out equipment is then able to monitor that the VOBC reacts correctly.

The most important logical and control functions of the VOBC are: (a) data communication; (b) velocity control; (c) position measurement (d) position supervision; (e) switch control and supervision; (f) door control and supervision; (g) coupler control; (h) correlation between vehicle and guideway co-ordinates; and (i) health monitoring.

In data communication the VOBC receives command telegrams via the inductive loop. The VOBC checks the telegrams for transmission errors with a redundancy check which guarantees a minimum Hamming distance of 4. The telegram is not accepted if the telegram fials the redundancy check. From the telegram the inductive loop identification is extracted and then the vehicle address contained in the telegram is tested. The rest of the information is only used if the telegram contains the vehicle's address (identity).

At a fixed time interval after receiving a telegrram, the vehicle starts transmitting a reply telegram to the VCC containing important status information. This telegram also has a minimum Hammering distance of 4.

For velocity control in the command telegram, the VOBC is given a maximum velocity, the co-ordinates of its stopping point, a target velocity and a value for the deceleration rate. Together with its position information and received data, the VOBC calculates the required velocity and, depending on the form of the AFB, outputs either a signal proportional to the required velocity, or compares the required velocity with the instantaneous velocity and outputs a signal to command accelerate, decelerate or roll.

The VOBC continuously measures the instantaneous velocity and compares this with the velocity it commands the AFB. As soon as the instantaneous velocity exceeds the commanded velocity by a specified amount, the VOBC commands aplication of the emergency brakes. Basic position information is from the crossovers in the inductive loop (coarse position) and the inductive loop identification together with entrypoint. The inductive loop identification, in every telegram the vehicle receives, together with the number of counted crossovers in this loop form the vehicle's position. Dependent on travel direction, the VOBC counts the crossovers down- or up-wards. Because the vehicle's position is one of the most important parameters from the safety point of view, the position is determined by two independent systems, that is, the crossover detection (coarse position) and the fine position. One coarse position unit equals 64 fine position units. The fine position (and travel direction) is derived from two synchrogenerators (two used for safety). The fine position information is used as a backup for the coarse position and gives a facility for the vehicle to stop at half crossover increments.

The vehicle monitors discrepancies between the coarse and fine position generators. As soon as the discrepancy exceeds a specified amount, the emergency brakes are applied. The vehicle continuously compares its actual position with its commanded stopping position and applies the emergency brakes if the vehicle overshoots the stopping position by a specified amount.

The incoming telegram contains a switch command which the VOBC outputs to the switch equipment, and a lock-unlock bit. So long as this bit indicates "lock," the VOBC does not accept any changes in switch position. The status of the switch is monitored and sent to the VCC in a reply telegram.

The command telegram contains door opening instructions for either left or right doors. This information is given in guideway co-ordinates, The VOBC transforms this information into vehicle co-ordinates, checks if its velocity is O and the stopping position is correct, and then commands the doors to open. The door status is returned to the VCC. The VCC withdraws the door opening instruction as soon as it receives the "open" status. The VOBC commands "close doors" after a programmable time.

When a departure command is received from the VCC, the VOBC first checks if the doors are closed before commanding the vehicle to depart.

The coupler command is received in guideway coordinates. The VOBC transforms this into vehicle coordinates and outputs a command to activate or deactivate the required coupler. The VOBC compares the commanded state with the actual state of both couplers and informs the VCC that the couplers are either in the commanded state or not in the commanded state.

For correlation between vehicle and guideway coordinates, on entering the automated area, the VOBC receives a special telegram from the loop-begin feeding device indicating the direction in which it must count the crossovers, i.e. either count-down or count-up. The VOBC detects its own travel direction (in vehicle coordinates) and stores this information. With this information the vehicle correlates and transforms VCC commands (given in guideway co-ordinates) such as travel direction, door opening and coupling commands into commands in vehicle co-ordinates.

At subsequent loop changes, this correlation is recalculated by decoding the "old" and "new" inductive loop identity.

For health monitoring information, the status of different units in the vehicle (e.g. motor temperature, hydraulic pressure, fire, etc.) are input to the VOBC. In addition, the VOBC monitors the validity of the non-equivalent input signals. If failures arise, the VOBC reacts in a defined manner such as emergency braking, service braking and/or failure information to the VCC.

Figure 10:
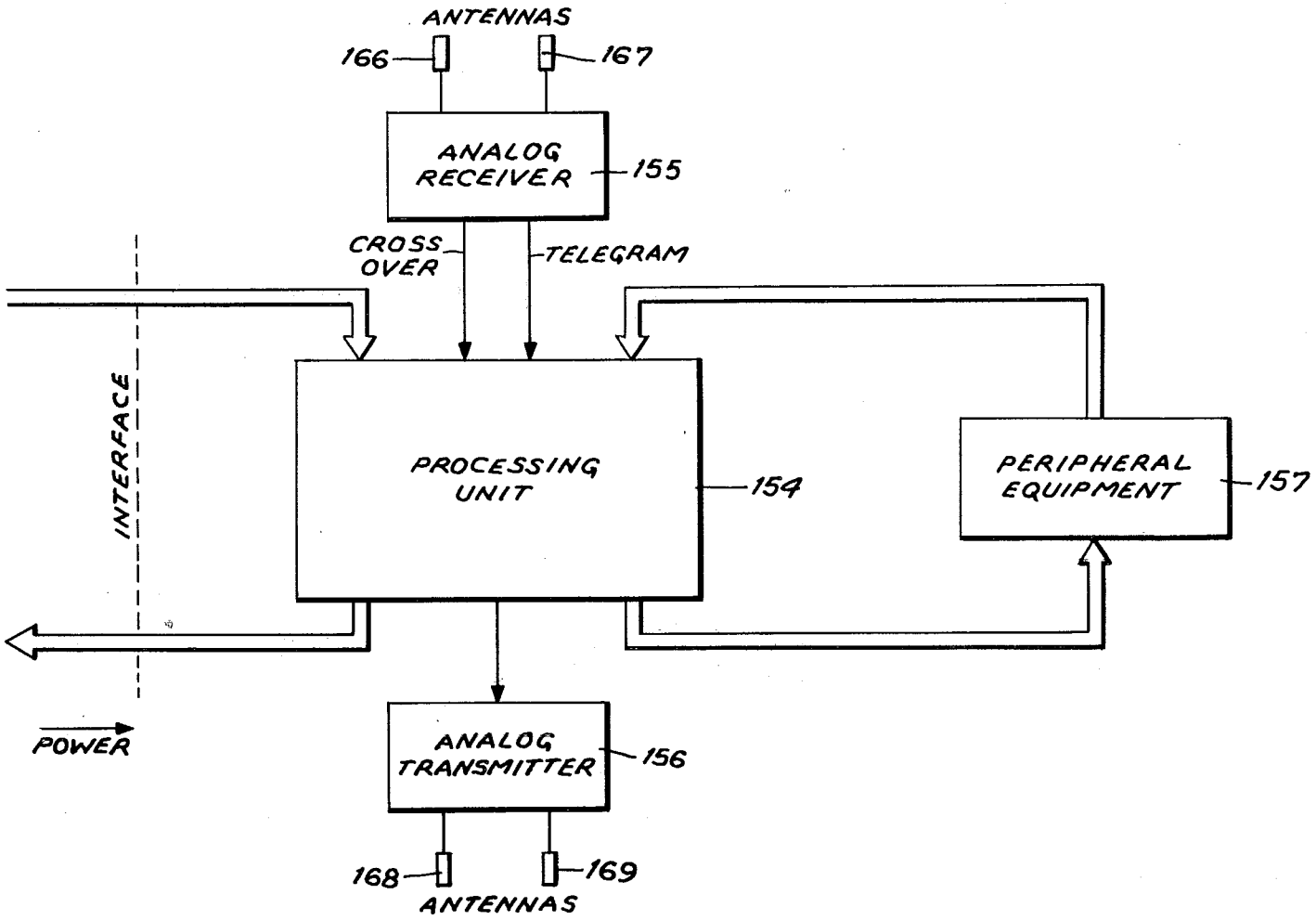
FIG. 10 is a block diagram of the vehicle on board control system of FIG. 9.

Referring to FIG. 10, the VOBC hardware may be considered in four main parts, the processing unit 154, the data receiver 155, data transmitter 156 and peripheral equipment 157.

Inputs to processing unit 154 are the serial command telegrams having the format of TABLE I, the crossover detection signals and status information from the rest of the VOBC and peripheral equipment 157. Outputs from the processing unit 154 are serial reply telegrams having the format of TABLE II and commands to peripheral equipment 157.

Figure 11:
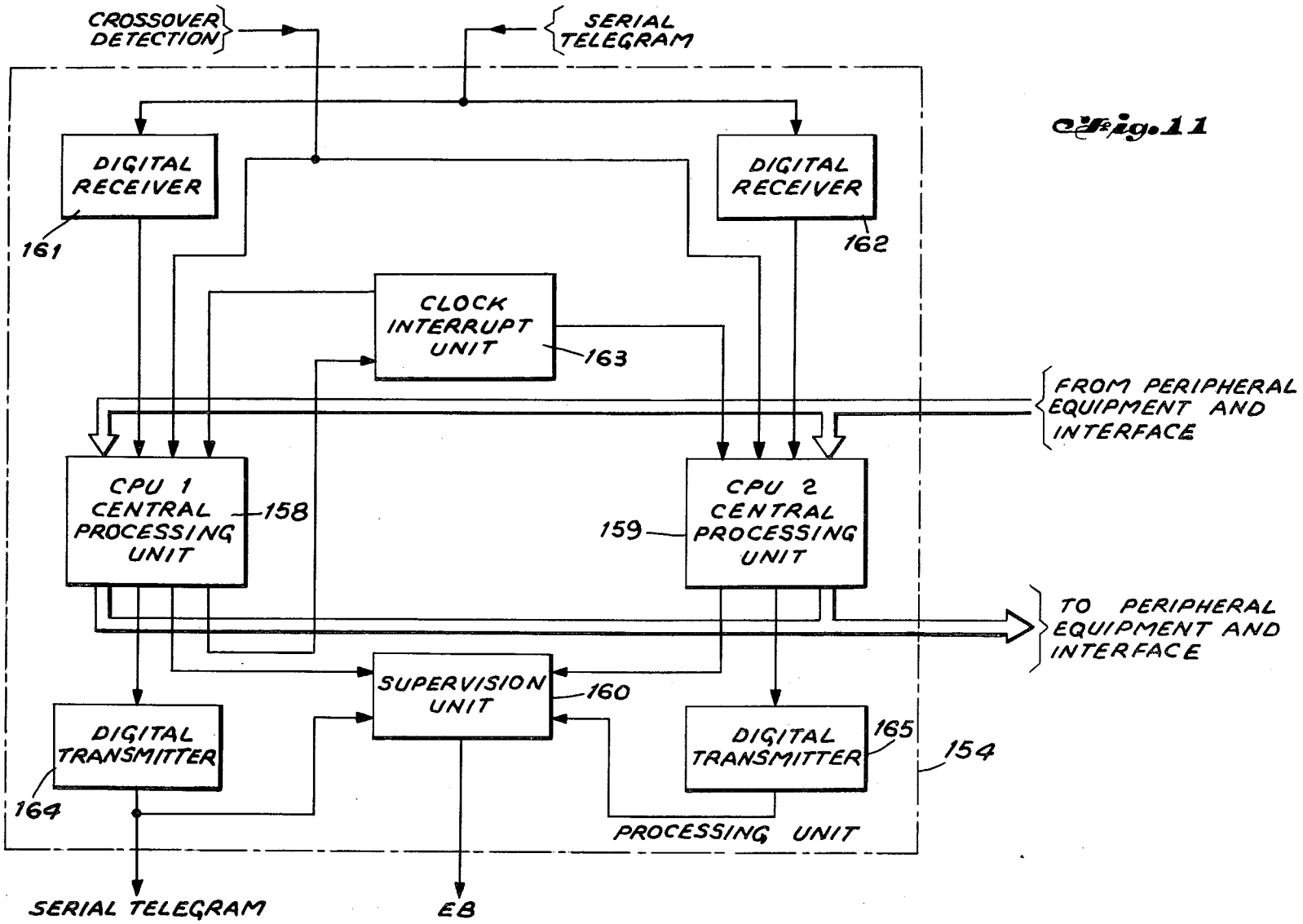
FIG. 11 is a block diagram of the processing unit of FIG. 10.

Processing unit 154 is disclosed in greater detail in FIG. 11. The data is processed in two parallel branches through central processing units (CPU) 158 and 159. The outputs of units 158 and 159 are continuously compared in a fail-safe supervising unit 160. Unit 160 activates the emergency brakes EB if a discrepancy between the two branches is detected. This guarantees a safe processing of the input data since any failure in one of the branches will cause different outputs and is therefore detectable. The serial command telegram is decoded in digital receivers 161 and 162 to detect the telegram synchronization word and then converts the serial telegram to parallel words for input to CPUs 158 and 159. The CPUs 158 and 159 are controlled by the interrupt unit 163.

Outputs from CPUs 158 and 159 are fed to independent digital transmitters 164 and 165 and to the rest of the VOBC and vehicle periphery equipment. The digital transmitters 164 and 165 converts the parallel outputs of CPUs 158 and 159 into a serial telegram. The serial outputs of digital transmitters 164 and 165 are continuously compared by supervision unit 160 and the output of one of the transmitters such as transmitter 164 is fed to the analog transmitter 156 of FIG. 10.

If the fail-safe supervision unit 160 detects a discrepancy between the outputs of transmitters 164 and 165, it immediately initiates the emergency brakes because a correct output telegram is then no longer guaranteed.

The analog receiver 155 of FIG. 10, in addition to demodulating the incoming frequency modulated telegram signal, detects each 180° phase change in the signals received by the two antennas 166 and 167. A signal is output to CPUs 158 and 159 (FIG. 11) at each phase change to indicate detection of a crossover in the inductive loop. Circuitry in receiver 155 ensures that the received telegram signal is not attenuated or distorted at the crossovers.

Serial bit-trains from digital transmitter 164 (FIG. 11) frequency-modulate a carrier in analog transmitter 156 (FIG. 10). The resultant signal is output to the transmitting coils on antennas 168 and 169 for radiation to the inductive loop. Circuitry in transmitter 156 ensures that the information on the signal injected into the inductive loop is not distorted as the crossovers.

The VOBC peripherals of peripheral equipment 157 (FIG. 10) are: (a) synchro-generators; (b) emergency brake relay unit; (c) interfaces to other vehicles in train; (d) interface to check-out equipment; (e) optional marker detection; and (f) optional bay-gate communication.

For reasons of safety there are two generators, each coupled to an idler axis of the vehicle. Each synchro generates a 3-phase signal from which fine position increments, instantaneous velocity and travel direction are derived. This information is input to CPUs 158 and 159 (FIG. 11).

Inputs to the emergency brake relay unit are: (a) signal from supervision unit 160 to initiate the brakes in the event of discrepancies between the parallel processing systems; and (b) signals from CPUs 158 and 159 to initiate the brakes on CPU command, e.g. in the event of overspeed, and signals to release the brakes.

The output signal from the relay unit has direct control over the emergency brake valve.

For interface to other vehicles in a train, the output signals from the processing unit 154 are converted into signals suitable for intra-train communication. In the return direction, the intra-train signals are converted into digital signals for input to processing units 158 and 159.

The interface to the check-out equipment comprises the connections at which the complete VOBC interface is available.

For optional marker detection, the markers on the guideway are passive tuned circuits, as described with respect to FIG. 8. The detector on the vehicle radiates the corresponding frequency and detects only markers which are tuned to this frequency.

For optional bay-gate communication and status information to and from the bay-gates is transmitted and received by inductive coil transmitters and receivers which have a limited range substantially as illustrated in FIG. 4. This is part of the enabling system for vehicle door and bay-gate opening when the vehicle is at the correct station stop position.

In train operation all the VOBCs are switched on and are, in principle, fully able to control the train. Normally the VOBC of the leading vehicle acts as the active (command) VOBC and controls main functions such as data communication with the VCC and velocity control. The trailing vehicles "know" the identity of the active VOBC and are, therefore, able to "listen" to the appropriate telegrams and perform some commands, e.g. door opening and switch control. They do not, however, send reply telegrams.

The leading VOBC outputs a "live" signal to the trailing VOBCs indicating that it is functioning correctly. As soon as this signal disappears, the train will go into an emergency braking process. When the train has stopped, the VOBC of the second vehicle will take over the active function, i.e. VCC data communication, velocity control and also the output of the "live" signal. On this "live" signal, all emergency brakes are released and the train is able to travel under automatic control to the next station so that passengers may leave. The train is then commanded to a maintenance area.

3. VEHICLE CONTROL CENTER (VCC) (FIGS. 12 – 20)

Figure 12:
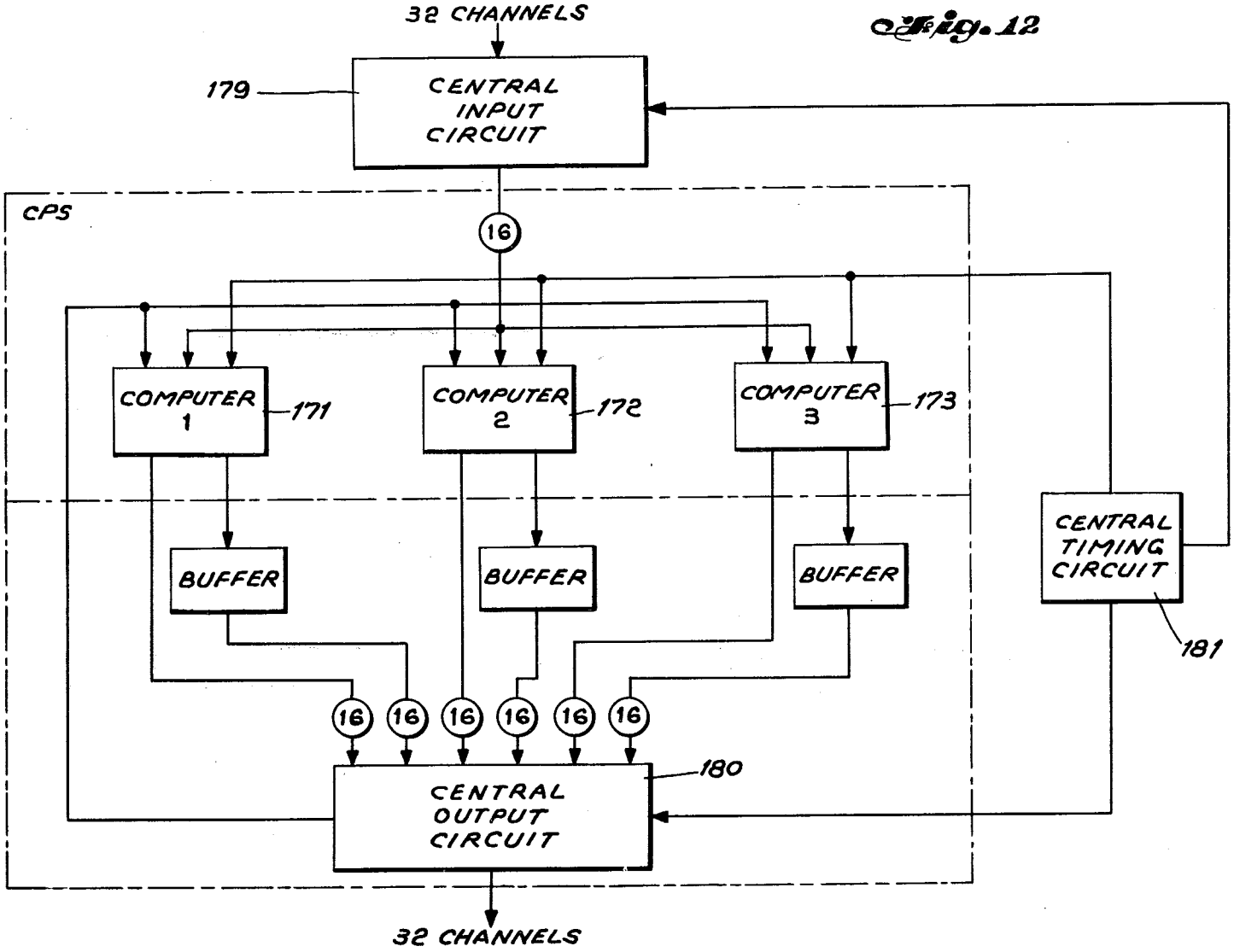
FIG. 12 is a general block diagram of the vehicle control center of FIG. 2.
Figure 13:
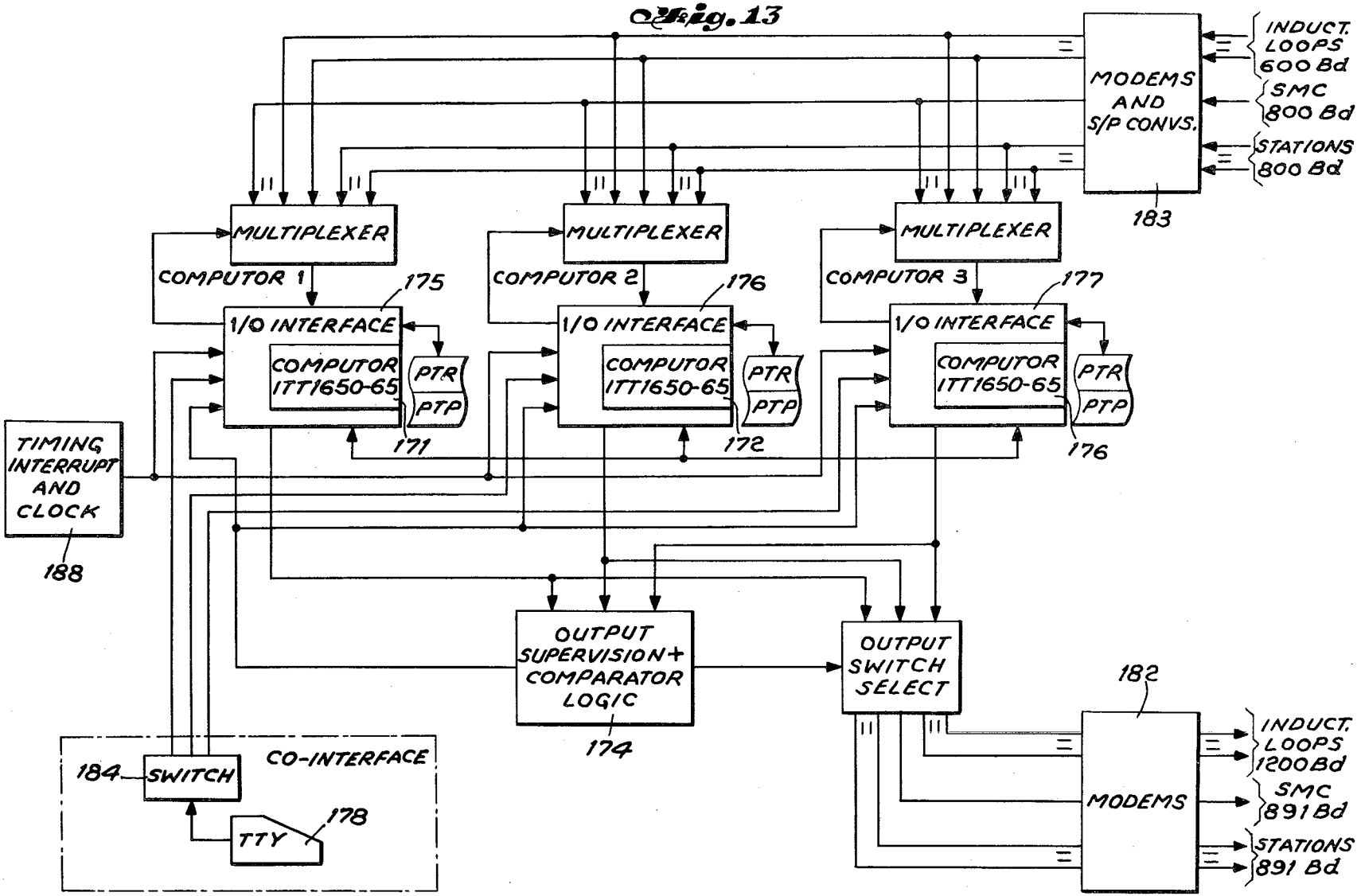
FIG. 13 is a more specific block diagram of the vehicle control center of FIG. 2.

Referring to FIGS. 12 and 13, there is illustrated therein the components of the VCC employing three computers 171, 172 and 173. Peripheral logic and data communication links in conjunction with the three computers 171 – 173 is the primary center of the control system of the present invention. The VCC operates with a fail-safe philosophy using redundancy and self-monitor techniques. This is particularly evident in the manner in which commands are issued to the vehicles. Each of the three computers 171 – 173 calculates these commands. The results are compared and monitored in output supervision and comparator logic 174 and the command itself contains redundancy. In operation, two of the three computers are on-line and the third computer is on "hot" stand-by ready to take over should one of the on-line computers fail.

Principle tasks of the VCC derive from the data exchanged with other system parts: (I) from data exchange with the vehicles (a) interpretation of telegrams from vehicles; (b) evaluation of stopping distance and position, maximum velocity and deceleration functions derived from the route conditions (fixed and temporary velocity limitations, stops, preceding vehicles, assigned velocities based on headway control); (c) position determination; (d) plausibility checks; (e) requirements of route assignment; (f) determination of switch information; (g) route monitoring; (h) merging of vehicle streams; (i) processing of passenger activated stop requests and emergency stops; (j) assignment and monitoring of travel direction; (k) control and supervision of vehicle and bay doors; (l) control and supervision of coupling and decoupling; (m) activation of vehicle on-board systems; (n) monitoring of vehicles in storage areas; (o) supervision of switch position; (p) interpretation of error reports; (q) taking vehicles over from the non-automated area; and (r) control of emergency brakes. (II) From data exchange with the SMC (a) route assignment; (b) assignment of velocity restrictions for the overall system and velocity limit recommendations; (c) departure commands; (d) station stop commands and position; (e) data for vehicle activation and required operating mode; (f) train formation requests; (g) transmission of vehicle positions and conditions; (h) transfer of error reports; (i) transmission of velocity restrictions or closed sections of the track; and (j) coupling verifications. (III) From data exchange with the central operator (a) input of temporary velocity restrictions and closing of track sections; (b) changing of velocity profiles and safety distances; (c) taking vehicles into and out of service; (d) route changing in degraded line haul mode; and (e) operations and error messages.

The internal tasks of the VCC are basically: (a) interrupt control; (b) input/output control; (c) priority control; (d) monitoring peripheral devices; (e) three-computer synchronization and equalization; (f) initialization programs (start/restart); (g) daily operations (start-up/shut-down); (h) output logic verification; and (i) calculation of redundancy bits for output telegrams.

The VCC is subdivided into five functional system groups. The first group is the central processing system which comprises computers 171 – 173, each with its own input-output (I/O) interface 175 – 177, standard peripherals, a switchable teletypewriter for maintenance and a common but switchable teletypewriter 178 for operational use. The second is the central input circuit 179, comprising the hardware to input data from the other system parts (via the modems) to the central processing system via the input-output interfaces 175 – 177. The third system is the central output circuit 180, comprising the hardware to output data telegrams (from the interface) to the other system parts (via the modems) and to monitor and compare the outputs from all three computers. The fourth system is the central timing circuit 181, comprising the hardware to generate various timing pulses which control the hardware functions and provide the basic VCC cycle pulse and computer interrupt for the central processing system. The fifth system are the modems including modem 182 which converts logic levels from the central output circuit 180 to frequency modulated signals suitable for line transmission to other system parts and modems 183 to convert incoming frequency modulated signals into logic levels compatible with the central input circuit 179. Computer 171 has associated therewith the interface 175 and standard peripheral paper tape reader PTR and paper tape punch PTP. The other computers 172 and 173 are configured as explained above with respect to computer 171. The interface rack contains the central input and central output control timing and data receivers. The data transmission rack contains the modems 182 and 183. The central operators "common" teletypewriter 178 may be switched to single, pairs or all three computers through switch 184. The maintenance teletypewriter (not shown) can be switched to only one computer at a time.

Figure 14:
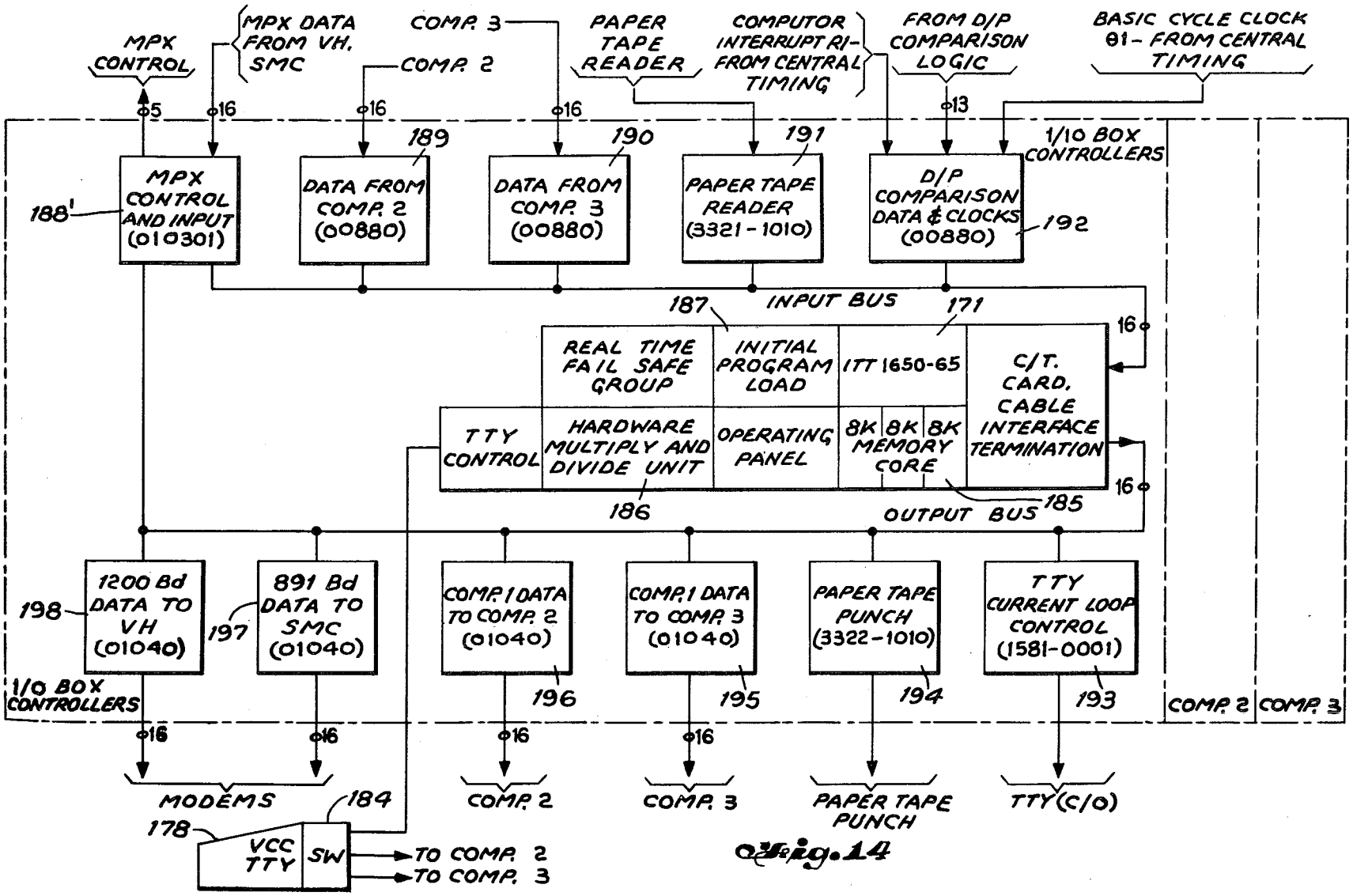
FIG. 14 is a block diagram of the central processing system of FIG. 13.

Referring to FIG. 14, there is illustrated in greater detail a block diagram of one computer group of the central processing system (CPS) with each group being identical and comprising a computer, input-output interface and, as standard peripherals, a paper tape punch and reader. Two teletypewriters are associated with this CPS.

Each computer is an ITT 1650-65 stored-program digital computer with 16-bit word length organization, a high speed memory and a versatile arithmetic and control unit. The ITT 1650-65 has the following brief specifications: (a) eight foreground general purpose registers; (b) eight background general purpose registers; (c) 16-bit parallel operation; (d) 960 n (nanoseconds) single cycle time; (e) 24k memory 185; (f) hardware multiply and divide unit 186; (g) bit, byte and word addressing; and (h) a repertoire of 78 program instructions in the initial program mode section 187.

The VCC has a modular software concept and runs under an executive control, performing all essential tasks in a 70 ms cycle. The processing cycle and the output and input of data are determined by two timing signals from the central timing circuit 181 (FIG. 12). One timing signal is the basic cycle pulse of 69.583 ms (70 ms) and the other is the "computer interrupt" of 83 pulses per 70 ms cycle as shown at 188 of FIG. 13.

Both instructions and data are stored in the ITT 1650-65 memory. Eleven addressing modes are provided for memory reference instructions which may address any location in memory. Nine instruction groups, which include a total of 78 instructions, are standard on all processor models. Five additional instructions, including hardware multiply and divide may be installed. The instruction-set operations include: (a) bit instructions that will test, set or reset any bit in memory, allowing the efficient use of logical variables; (b) byte instruction to load or store any byte in memory, or to switch the contents of two bytes in a word; this greatly simplifies handling of character data; (c) register-to-register and literal (immediate) -to-register arithmetic and logic instructions. These instructions may generate results which are stored in a register, or the results may be reflected in status indicators only (indicating greater than, less than, zero, non-zero, plus, minus, etc.); (d) a compare-memory-with-register instruction which reflects results in status indicators only. This allows efficient seraching of memory for specified values; (e) ability to load an instruction into a register and execute it. This feature facilitates the use of procedure-only programs in a read-only memory; (f) jump to a subroutine and return via the address in the E register. The technique of saving the return address in a hardware register decreases subroutine and interrupt processing overheads; and (g) load all registers and status, or save all registers and status. Each of these operations requires only one instruction and greatly simplifies coding of interruptable and re-entrant programs.

The set of eight 16-bit general purpose registers is standard on all processor models. The foreground-background option includes an additional set of eight registers making a total of sixteen general purpose registers with a facility for switching from one set of the eight registers to the other set of eight registers (i.e. selecting the background or foreground mode). All general purpose registers may be used as accumulators for arithmetical and logical operations, as program loop counters, or as data input-output buffers.

In addition to the functional capabilities common to all general purpose registers, certain general purpose registers have special properties. One register is used in pre-indexed (base relative) addressing. When an instruction specifies base relative addressing, the address field of the instruction is added to the contents of this register to determine the memory location to be referenced by the instruction.

Three registers are designated post-index registers. When one of these registers is specified in an instruction as an index register, the specified register's contents is applied to the computer address to determine the word or byte in memory to be referenced. One register serves as a subroutine return register. It holds the return address after a jump-to-subroutine (JSR) is executed or a program interrupt occurs.

The ITT 1650-65 input/output system is designed for maximum efficiency and flexibility. Data moves between the computer and peripheral devices under program control. A program may poll devices to determine if they are ready to be serviced, or the devices may be allowed to interrupt when they require service. A program communicates with peripheral equipment via input-output (XIO) instructions. Four classes of XIO instructions provide data input, data output, control and test functions. An XIO instruction addresses any one of up to 64 input-output modules of which two are internal to the processor (standard teletype and masking internal interrupts). The remaining 62 device select addresses may be assigned to peripheral input-output modules as needed. An active priority interrupt system minimizes interrupt response time. For each of the 64 possible input-output modules that may be interfaced to the computer, there is a dedicated memory location which may contain that modules interrupt service routine address. When the processor acknowledges an interrupt, control is transferred (in a single memory cycle) to the address stored in the interrupting device's dedicated memory location. By virtue of arriving at the addressed routine, the interrupting module is identified.

Safety features are provided for the ITT 1650-65 computer. These features ensure reliable operation even in remote or unattended environments. The power fail detection feature ensures that the contents of memory are preserved in the event of a power failure. Other safety features are: (a) relative time clock. This feature provides an interrupt every 1000 memory cycles when the interrupt level from the relative time clock (RTC) is enabled. In addition to providing a multi-programming capability, the interrupt may be used to protect against unusual conditions by the periodically returning control to a system monitor program. The interrupt from the RTC may be enabled or disabled under program control. To ensure that control is periodically returned to the monitor program, the operations monitor alarm counter may be invoked; (b) operations monitor alarm (OMA). The OMA protects the system against abnormal operation and provides a signal to warn of abnormality. Once activated, the OMA brings instruction execution to a steady halt and changes the system safe signal to the unsafe condition. This signal can be used to control an audio-visual alarm or automatic switchover. The pulse operation monitor alarm (PMA) instruction is provided to both set the alarm and to reset it during normal operation. The instruction starts the alarm timer when it is executed for the first time and resets the timer each time it is executed thereafter. Failure to execute the instruction within 200,000 memory cycles after the previous signal activates the alarm. When the alarm becomes activated the computer automatically switches from the run mode to the idle mode and the safe signal is removed from the line. The OMA may be cleared by auto-restart or by manually pressing the systems reset switch at the computer console. If the OMA is cleared by the systems reset switch, the program must be restarted manually; (c) power failure interrupt. This feature issues a warning to the running program if the unregulated D.C. voltage drops below a predetermined limit (approximately equal to 105 volts D.C. for a fully loaded system). The warning is in the form of a program interrupt that transfers control, via an indirect memory location, to a power-fail service routine. The service routine can then save register contents and bring the system to an orderly shutdown before D.C. power drops below a critical level. At the same time the interrupt is requested, the OMA timer is initialized to time-out in 100 memory cycles. Any further PMA instructions or data-channel requests are ignored. After 100 memory cycles, the OMA and the machine goes through a normal alarm sequence (except that the safe signal is not removed from the line). The regulated D.C. voltages are guaranteed to be good at the time of the alarm sequence; (d) auto-restart interrupt. This feature causes an orderly start-up with a special restart interrupt when power is restored after a power failure. When the unregulated D.C. voltage goes above a predetermined value, the auto-restart circuit requests an interrupt on its preassigned level. The service routine that is activated as a result of this interrupt may restore registers and status and return control to the program. Thus computers placed at remote locations do not require operator intervention for restart after a power failure. The entire system is initialized by system restart switch prior to the auto-restart interrupt request.

The ITT 1650-65 computer with its combination of general purpose registers, nine instruction groups, eleven addressing modes and an active priority interrupt system with unique levels offers the following features: (a) the ability to directly address any word, byte or bit in memory eliminates the need for paging. Program relative addressing allows programs to be self-relocating (i.e. they will run without modification anywhere in memory); (b) base relative addressing allows the independent location of data and instructions. Temporary storage required by subroutines can be allocated dynamically, thus minimizing memory requirements by allowing subroutines to share portions of memory; (c) a concept of dynamic storage allocation when combined with a number of special instructions, such as store all registers and status and load all registers and status, greatly simplifies coding of interruptable, re-entrant and recursive routines; (d) the active interrupt system reduces the overhead incurred when servicing a program interrupt from an external input-output module. Control may be transferred directly to the routine responsible for servicing the interrupting input-output module since each module has its own interrupt level; and (e) the ability to locate data and instructions independently and execute the contents of a register as an instruction allows any program to be written as pure procedure and, consequently, to be implemented in a read-only memory.

The input-output interface associated with each of the computers 171 – 173 of FIG. 13 comprises a group of modules installed in the computer rack and providing interfaces between the computer input-output bus and external equipment. Each module has a unique device select code for addressing by the computer and an interrupt vector code to enable the computer to recognize an interrupt request. FIG. 14 shows the eleven modules 188′ – 198 used in the VCC and their function.

The paper tape reader and punch are standard equipment and integral parts of the computer rack. Paper tape for the VCC is eighthole and can be read-in by the photo-electric paper tape reader at up to 400 characters per second. The computer is able to output punched tape from the paper tape punch at up to 75 characters per second.

The teletypewriters are associated with the VCC and are used for system operation and maintenance. Both of the teletypewriters are switchable. The system teletypewriter input/outputs are from/to the central operator's position. This teletypewriter 178 may be selected to send and/or receive from a single, pairs or all three computers. Control of this is from a separate switching box 184 located next to the teletypewriter 178. The maintenance teletypewriter can be switched to only one computer at a time. For this a simple switch arrangement is built into the teletypewriter.

Figure 15:
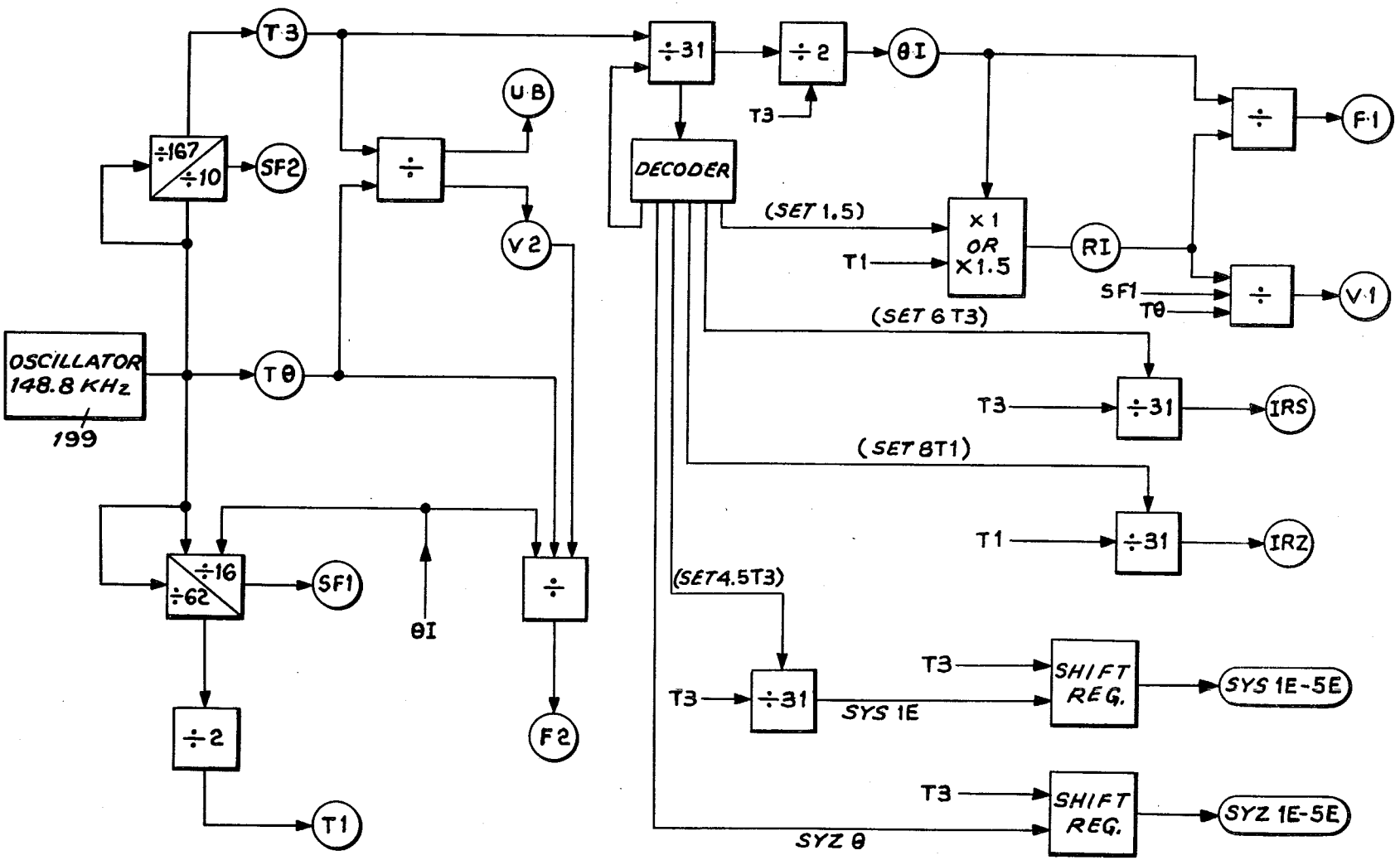
FIG. 15 is a block diagram of the central timing circuit of FIG. 12.

Referring to FIG. 15, there is illustrated therein a block diagram of the central timing circuit 181 of FIG. 12. This circuit produces timing pulses which control the various functions of the VCC hardware.

A basic clock pulse is generated by a crystal controlled oscillator 199 from which a series of timing pulses is developed in groups of counters and other logic elements. These pulses are synchronized and control the following functions: (a) basic computer cycle (70 ms); (b) computer interrupt (83 per cycle, 1200 Bd data output); (c) 891 Bd data output; (d) output comparison enable and interrogation; (e) error counting; (f) information-redundancy switchover between computer outputs; and (g) input telegram synchronization and clock.

The following TABLE III identifies the various timing pulse outputs produced in the circuit of FIG. 15.

TABLE III

Figures 16A, 16B, 16C:
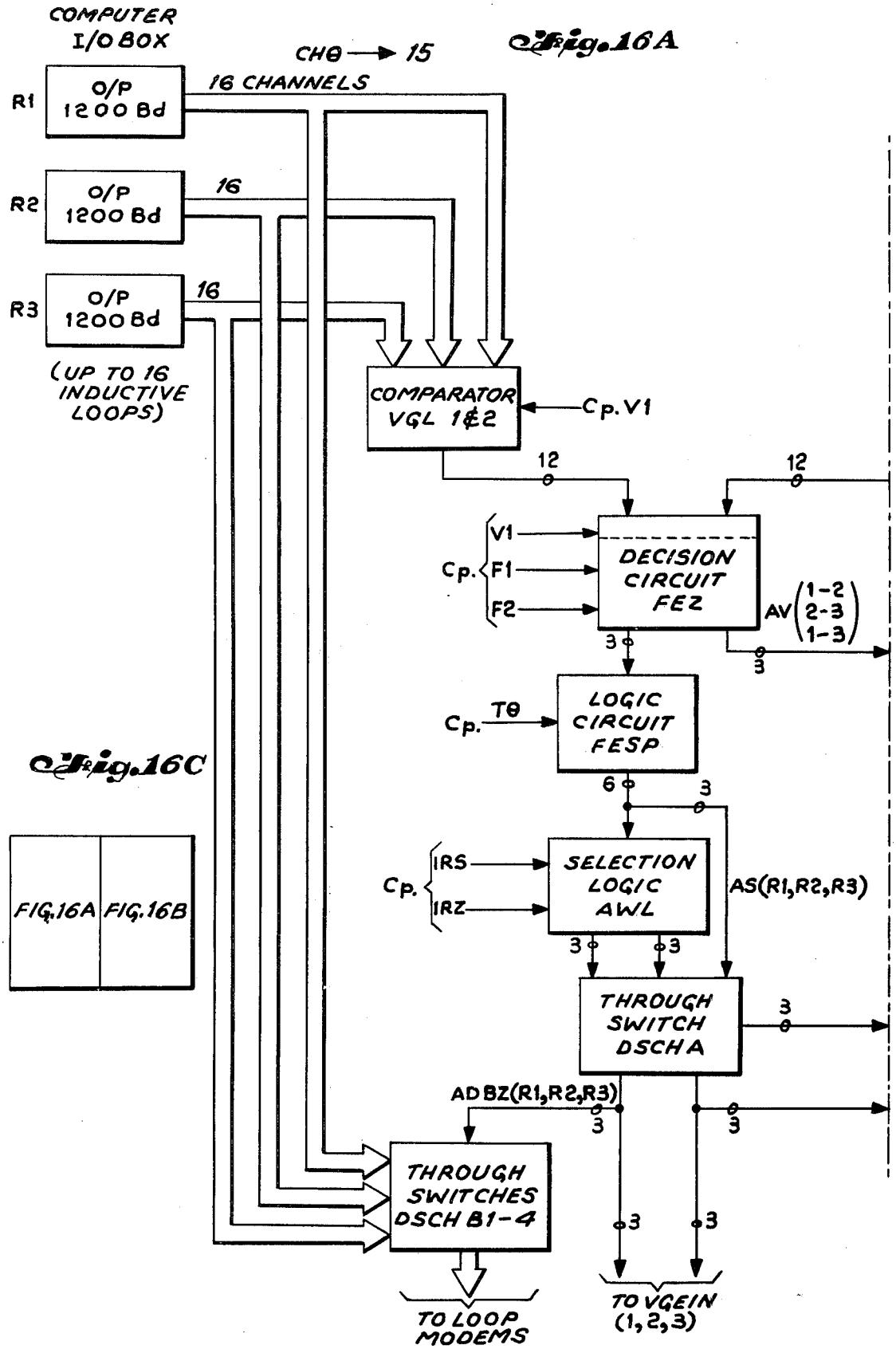
FIGS. 16A and 16B when organized as illustrated in FIG. 16C is a block diagram of the central output circuit of FIG. 12.
Figure 16B:
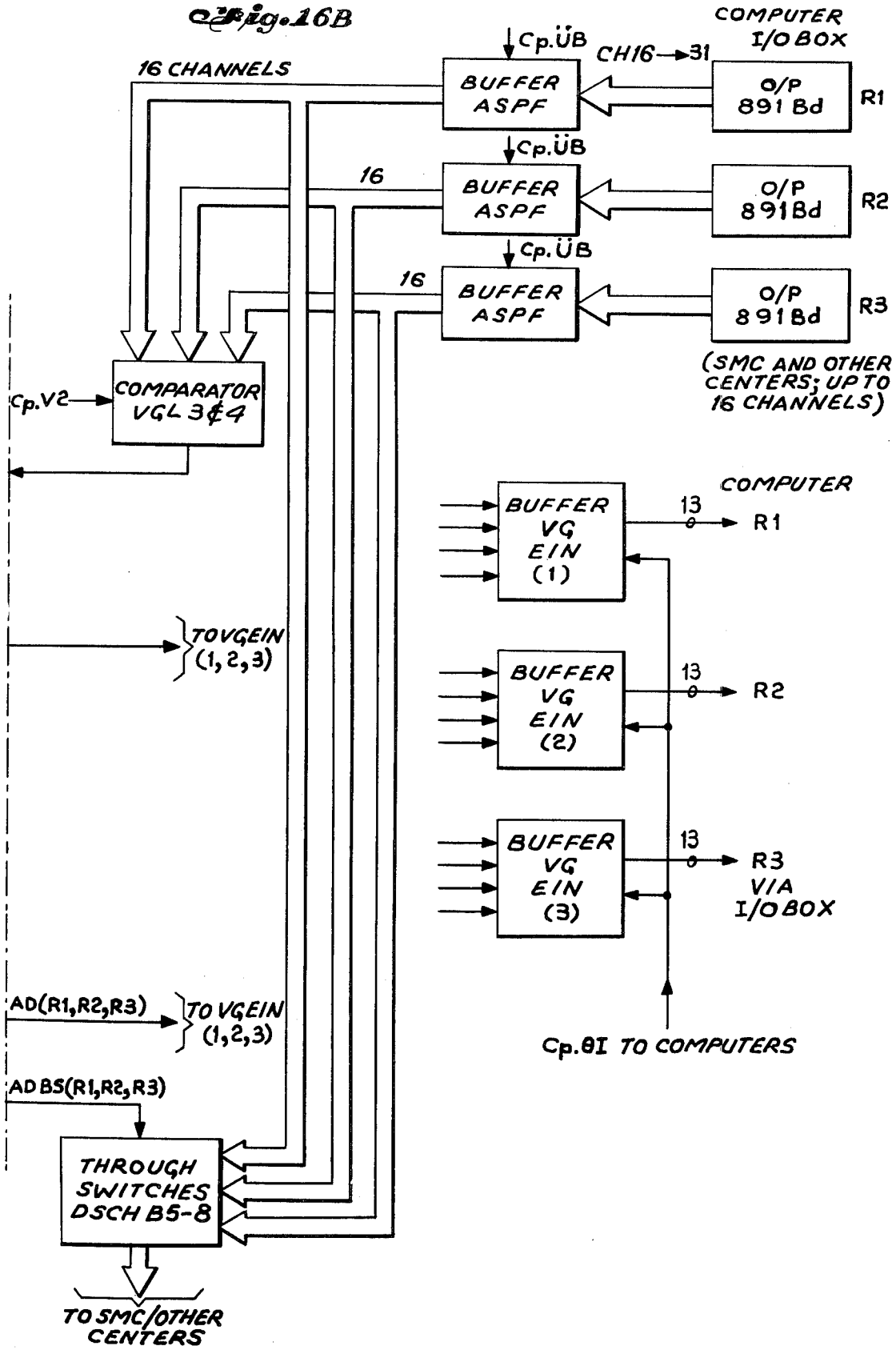

T0: Basic clock 148.8 kHz
T1: 2.4 kHz clock
T3: SMC/other centers data rate pulse 891 Bd
SF1: VH response telegram sync. clock
SF2: 32 bit response telegram sync. clock
01: Basic VCC cycle pulse 69.583 ms (70 ms)
SYS*E(A): Sync. pulse 32 bit response telegrams
SYZ*E(A): Sync. pulse VH response telegrams
RI: Computer Interrupt: 83 per cycle
IRS: Information - Redundancy O/P timing to SMC/other centers
IRZ: Information - Redundancy O/P timing to VH's
V1: Strobe Pulse Comparators: O/P to VH's
V2: Strobe Pulse Comparators: O/P to SMC/other centers
UB: Load Pulse O/P Buffer 891 Bd
F1: Error Counter Interrogate
F2: Error Counter Reset Referring to FIGS. 16A and 16B when organized as illustrated in FIG. 16C, there is illustrated a block diagram of the central output circuit 180 of FIG. 12. This circuit determines which of the computers 171 – 173 is to output the information part and which the redundancy part of telegrams to vehicles, neighboring VCC's, SMC and station equipment. Under the control of the central timing system of FIG. 15, the central output circuit has the following main functions: (a) take serial telegrams at 891 Bd from all three computers and load into buffers; (b) from the buffers, through-switch the information part of the above telegrams from one computer and the redundancy part from another computer; (c) for the 1200 Bd serial telegrams, through-switch the information and redundancy parts from the same computers as above; (d) determine which computer is to supply information and which the redundancy parts, from the result of a bit-by-bit comparison between the three computers for all 32 channel outputs in the previous cycle; and (e) present the results and status from (d) above to all three computers so that each computer may verify the correct functioning of the central output circuit.

The comparison, monitoring and through-switching of computer output data bits are basically similar for both 891 Bd and 1200 Bd channels. Comparison, monitor and feed-back to the computers occur in the following sequences for one process cycle of 70 ms: (a) as each identically computed bit appears at the output of each computer, a comparison is made between pairs of computers; i.e. computer 1 - computer 2, computer 2 - computer 3, computer 1 - computer 3. This occurs simultaneously for all 32 output channels; (b) if a comparator detects a disagreement, logic components decide which computer is in error; (c) detected errors are collected together for all 32 channels and counted up separately for each computer; (d) at the end of the process cycle, the number of errors for each computer is interrogated. If this is two or more, a bit in the hardware is set; (e) in the next cycle, a comparator showing two or more errors is inhibited from taking part in the through-switching of telegrams; (f) selection logic, conditioned by the interrogation "bit" and timing signals, selects one computer to output the information part of the telegram and another the redundancy part. These are the on-line computers; (g) if no computer shows more than two errors, the selection logic allocates which two computers are on-line. Additional logic prevents unnecessary switchover between computers in the event of sporadic bit-errors; and (h) signals from the specific parts of the output logic are buffered ready for interrogation by each computer. Two intervals are available for this. One occurs during the output of the last bit of a telegram, and the other during the output of the first bit.

For a VCC system with 32 channels, the central output circuit comprises twenty-five modules with the principle object to determine which computer outputs the information part and which the redundancy part of the telegrams to the vehicles, SMC and other VCC's. An output buffer ASPF is included for channels 16 – 31 of each computer to compensate for the difference in data rate between the computer interrupt (1200 Bd) and the 891 Bd telegrams.

Each computer outputs bits on all 32 channels at 1200 Bd (the rate of the computer interrupt RI), i.e. 83 bits in one 70 ms cycle. On specified interrupts, the software outputs bits on channels 16 – 31. The control pulse (Cp.) UB loads these bits in the output buffer, i.e. 62 bits in one 70 ms cycle (891 Bd).

The comparison, monitoring, and through-switching of computer output data bits are basically similar for both 891 Bd and 1200 Bd channels. Comparison, monitor and feedback to the computers occurs in the following sequences for one process cycle of 70 ms: (a) as each identically computed bit appears at the output of each computer or buffer, a comparison is made between pairs of computers, i.e. computer R1 - computer R2, computer R2 - computer R3, computer R1 - computer R3. This occurs simultaneously for all 32 output channels in comparator VGL1 and 2 for channels 0 – 15 and comparators VGL3 and 4 for channels 16 – 31; (b) if a comparator detects a disagreement, logic components in decision circuit FEZ decide which computer is in error; (c) detected errors are collected together for all 32 channels and counted up separately in circuit FEZ for each computer; (d) at the end of the process cycle, the number of errors for each computer is interrogated. If this is more than a specified number (N), a bit in logic circuit FESP is set; (e) in the next cycle, a computer showing N or more errors is inhibited from taking part in the through-switching of telegrams; (f) selection logic AWL, conditioned by the interrogation "bit" and timing signals, selects one of the computers to output the information part of the telegram and another the redundancy part. These are the on-line computers. The selection is implemented in through-switches DSCHA and DSCHB; (g) if no computer has N or more errors, the selection logic AWL allocates which two computers are on-line. Additional logic in logic circuit FESP prevents unnecessary switch-over between computers in the event of sporadic bit-errors; (h) if more than one computer has N errors counted in decision circuit FEZ and stored in FESP, the VCC is effectively shut-down; and (i) signals from the specific parts of the output logic are buffered in buffers VGEIN ready for interrogation by each computer. As before, two intervals are available for this one interval. One occurs during the output of the last bit of a telegram, and the other during the output of the first bit.

N is a system parameter and may be set between 1 and 5.

Figures 17A, 17C:
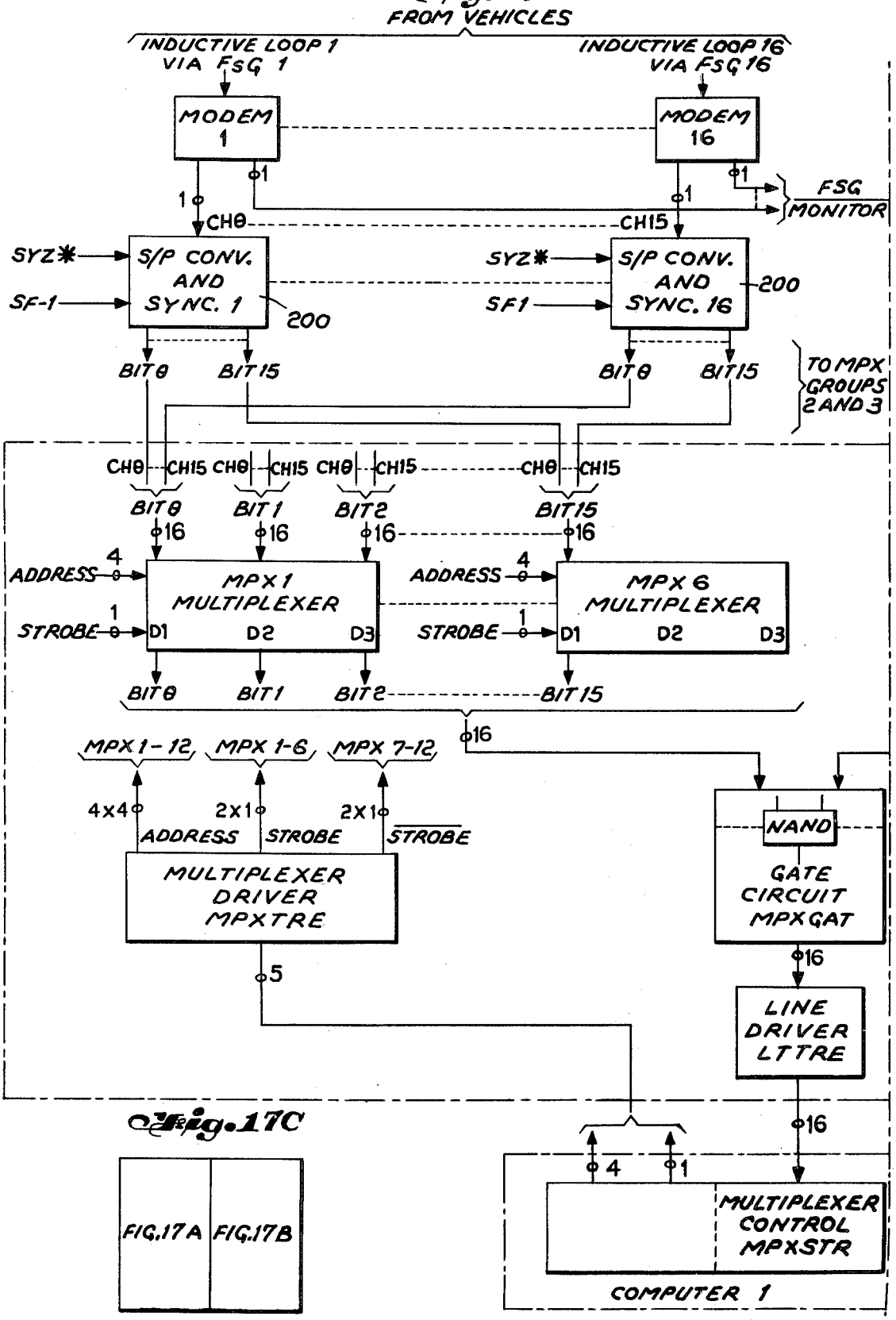
FIGS. 17A and 17B when organized as illustrated in FIG. 17C is a block diagram of the central output circuit of FIG. 12.
Figure 17B:
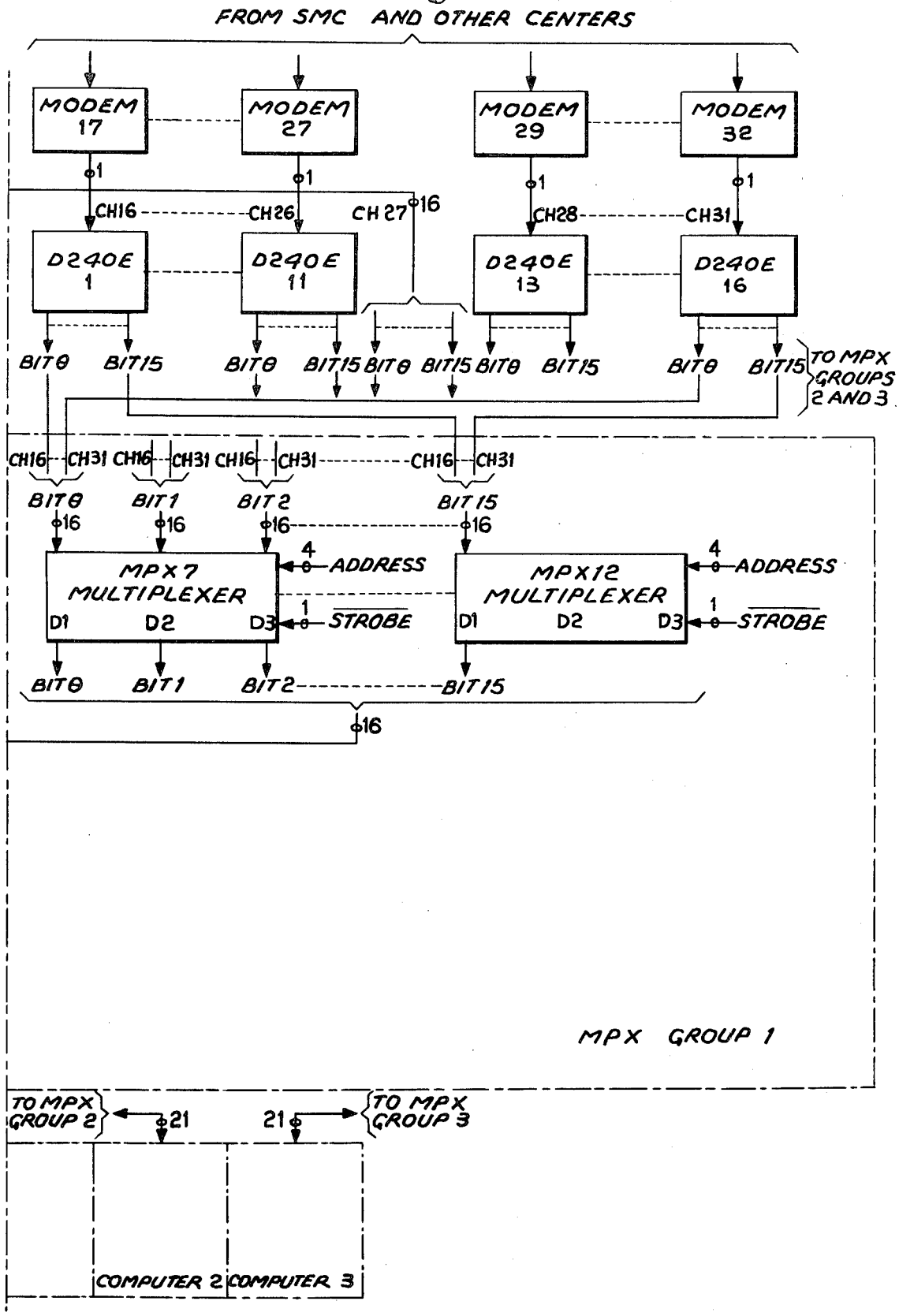

Referring to FIGS. 17A and 17B when organized as illustrated in FIG. 17C is a block diagram of the central input circuit 179 of FIG. 12. The circuitry of FIG. 17 parallel-converts incoming serial telegrams and inputs these telegrams to the computers. Each computer has its own multiplex group. The details of one multiplex group are shown. From the vehicles, incoming serial telegrams are input to a synchronizer and serial-to-parallel converter 200. Here a synchronizing pulse enables detection of logic 0 transition in the fourth telegram bit. Thereafter, the synchronizer generates shift and load-out pulses for the serial-to-parallel converter to output the telegram to the multiplexers in three words of 13 bits, 12 bits and 12 bits.

A multiplex module comprises three 1-out-of-16 multiplexer integrated circuits. MPX 1 – 6 are for vehicle reply telegrams. All 0 position bits of the 16 possible channels are input to multiplexers in multiplexers MPX 1 - D1. All 1 position bits are input to multiplexer MPX 1 - D2. All 2 position bits are input to multiplexer MPX 1 - D3. By similar grouping connections are made up to multiplexer input MPX 6 - D1 for all "bit 15s".

In a similar manner, incoming data from the SMC and other VCCs is multiplexed by multiplexers MPX 7 - D1 through MPX 12 - D1. Channel 27 is reserved for a 16 - bit word representing the integrity of up to 16 inductive loops. For the SMC and other VCCCs, serial telegrams are converted to parallel in the D24OE converters. From the associated input/output (I/O) interface, multiplex control MPXSTR outputs an enabling singal comprising a 4-bit address and strobe. The address selects one channel from channnels 0 – -and one channel from channels 16 – 31. The strobe signal selects the address channel from either group 0 – 15 or 16 – 31. The computer outputs address and strobe to the MPXSTR and accepts the multiplexed input words at specific intervals throughout the 70 ms cycle.

The multiplex driver MPXTE provides a fan-out capability for the address, the strobe and strobe signals. The address fan-out is four so that each signal controls three MPX modules. The strobe and strobe fan-out is two.

Gating between the 16-bit word from multiplexers MPX 1 - MPX 6 and a word from multiplexers MPX 7 - MPX 12 is achieved in the gate circuit MPXGAT. Since the group of multiplexers that is not enabled by the strobe pulse will output all logic 1, the NAND gates in gate circuit MPXGAT, therefore, function as an OR gate and gate through only the enabled multiplexers. The line driver LTTRE buffers the outputs of gate circuit MPXGAT to the multiplex control MPXSTR.

Safe VCC system operations require safe software. Since it is impossible to speak of "fail-safe" programs in the classical sense, special methods are used to ensure that no unsafe conditions occur because of software errors.

Since the Run Time Executive requires that the programs in different computers remain within a few hundred memory cycles of one another, it is not possible to have completely independent programs in each computer. Other methods are used such as changing the instruction order where possible, and linking the modules in different memory locations in each computer.

Read-only memory and memory-protection are used to prevent overwriting of programs. Any program trying to write in this area causes a memory protect violation which interrupts to an error routine. Data areas are protected with check-sum techniques. Each authorized program that may change a data list checks if the sum is valid before updating the data list and then re-calculates a new check-sum when update is complete.

The software designs must adhere to rigid standards. Deviations from these standards are not allowed. Structured programs with modular design allow good readability so that the modules can be checked easily by a second and third person before the module is accepted by the library.

Figure 18:
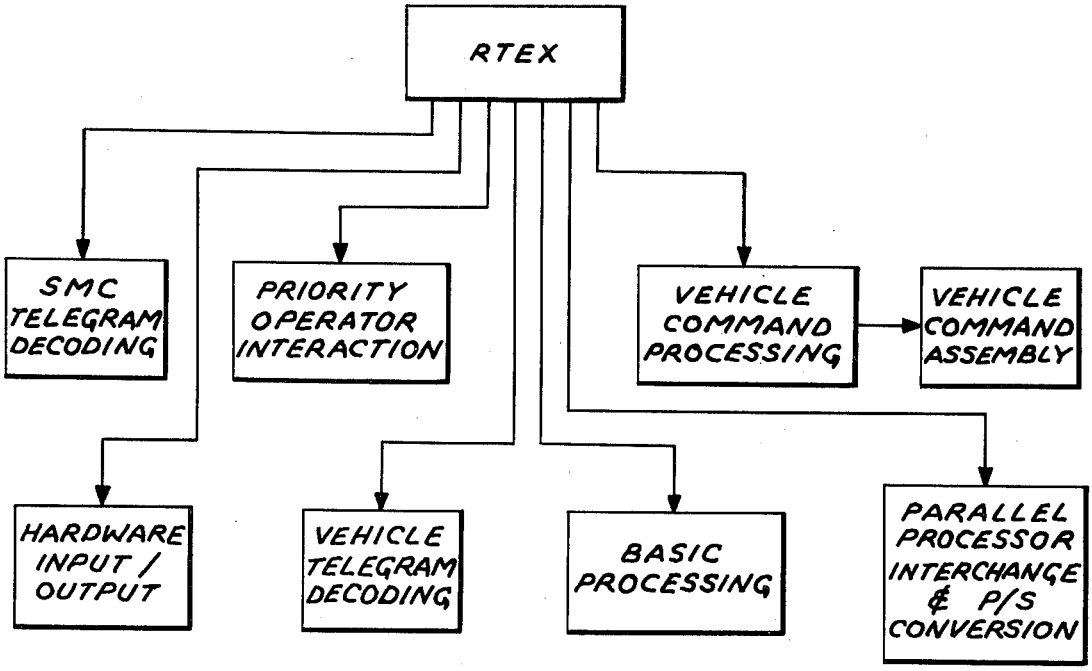
FIG. 18 is a basic vehicle control center software functional diagram.
Figure 19:
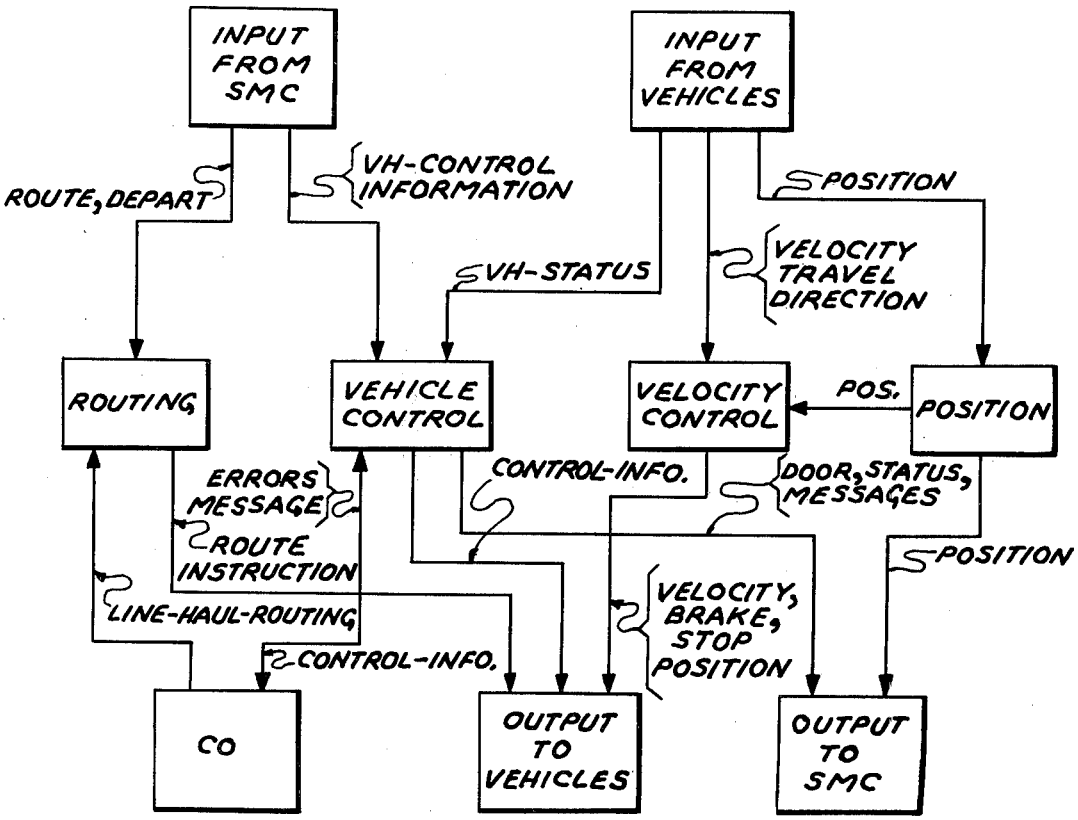
FIG. 19 is a block diagram illustrating the vehicle control center functional interaction.

Referring to FIG. 18 there is illustrated a block diagram showing the basic software functions and the main features of the VCC software are described hereinbelow. FIG. 19 illustrates the VCC functional transaction diagram.

The Run Time Executive (RTEX) regulates the flow of control through the VCC in time with the 1200 Bd vehicle telegram cycle which is repeated every 70 ms. RTEX handles the physical input-output (I/O) to the inductive loops, the inter-computer SMC connections and the input from the hardware monitoring and comparison circuits. In addition to timing and performing the input-output function, RTEX schedules procedure strings at significant time within the 70 ms work cycle. These procedures are described as priority processing.

The 1200 Bd clock (central timing) is the main hardware method of synchronizing the system since the interrupts are raised simultaneously on all three computers. While individual computers may have their interrupt systems disabled for minimum periods at the time of the interrupt, the design of RTEX is based on the fact that there will be no higher priority non-simultaneous interrupts in the system.

In the design of the scheduling logic of RTEX, interrupt handling logic and scheduled procedures need not be re-entrantly coded. This is justifiable since the bulk of scheduled procedure run in a batchlike manner in a controlled order repeated every 70 ms work cycle. Interrupts for the parallel processor equalization (PPE) data exchange are effectively solicited by the receiving computer so that these interrupts need not be stacked.

The parallel processor equalization system, used to synchronize the running of three parallel computers has the following tasks: (a) maintaining synchronism and equalizing a three-computer system during start-up, normal running, and shut-down of the system by maintaining equal system, vehicle and guideway data; (b) synchronizing a newly loaded, "cold" computer following the failure of one computer in the system; and (c) providing full systems availability of a three-computer system following the failure of one component.

The equalization approach is summarized briefly below; (a) the three-computer system is built on the concept that each computer receives identical inputs from the common multiplexed input hardware; (b) this is used and transformed uniformly in all three computers by a fixed set of input handling software. In this way the input updates the data model of the system identically in each of the computers in a batch-like procedure at the start of a processing cycle; (c) following the batch of fixed execution programs, equalization logic ensures the synchronous running of Vehicle Command Processing (VCP); (d) VCP is the major variable processing load on the system. It takes up the remaining time in the work cycle between the running of the fixed execution programs and prior to the mandatory output conversion logic which is started at the end of the work cycle. Equalization logic ensures that the same vehicle is processed in all computers at the same time, and that the status of the system is identical in each computer; and (e) an additional auxiliary function equalizes the variable lists in the system (e.g. the vehicle list). In an already synchronous system this is a purely preventive feature but it is the mechanism whereby a cold computer can be brought into synchronism.

Referring to FIGS. 20A and 20B when organized as illustrated in FIG. 20C there is illustrated a logic flow diagram of the vehicle command processing (VCP).

The main tasks of the VCP module are: (a) plausibility check on incoming vehicle data; (b) time supervision; (c) failure analysis of vehicle equipment; (d) updating the vehicle list; (e) vehicle command; (f) change position in vehicle list; and (g) switch reservation.

VCP checks the plausibility of the vehicle position and looks for certain bits in the telegram that should agree with specific data already known. For example, from the actual velocity, position and time differences, VCP calculates the possible position of the vehicle. If this agrees with the position received, the VCP then continues with a mask check. These bits include type of telegram, coupler status, and at specific times, door and switch status. If these checks are positive then processing continues.

The VCP then generates the following information for the vehicle telegram: (a) vehicle maximum velocity; (b) stopping point; (c) target velocity; (d) braking parabola number; (e) door control; and (f) route data.

Chaining entries in the vehicle list are made for branching, merging and entry into a new loop to enable the VCP to follow a vehicle through the system.

Priority operator interaction is used in conjunction with basic processing. This module controls the physical input/output of system teletype, and monitors and controls the allocation of the system teletype to the three computers. Furthermore, the scheduling of the basic process is initiated from this module.

The primary function of the basic processing is to process the command from the central operator. These commands include: (a) restart; (b) SMC start; (c) shutdown; (d) travel direction; (e) velocity restrictions; (f) closing of track-sections; (g) emergency brake release; and (h) vehicle entry/exit to the maintenance area.

Another function of this basic processing is the intercomputer data generation for the system management center.

For system safety, it is necessary to verify the correct functioning of the central output comparison and selection logic. To achieve this, specific signals indicating the status of the logic are made available to all three computers.

Information from the central output is available from a 16-bit word containing: (a) basic cycle pulse of 70 ms and the computer interrupt (1200 Bd); (b) through-switching commands for each computer; (c) an indication (for each computer) if a computer showed two or more output-bit errors in the previous cycle; and (d) indication (for each computer) if a computer showed any output-bit errors in the previous cycle.

From this input word the computers verify the logical and correct relationship that should exist between detected errors and the through-switching arrangement. The program comprises two main parts: (a) cyclic monitoring. This occurs in each 70 ms cycle. In this interval the following are verified: (1) synchronization; (2) comparator indications; (3) information-redundancy selections; (4) through-switching indications; and (5) computer and system break-down. (b) comparator testing. This takes place every three minutes when each computer, in turn, if forced to output data bits, one channel at a time, disagreeing with the data bits from the other two computers.

With this program, the computers are able to inhibit telegram outputs from one computer if the central output logic for that computer appears to be faulty.

4. SYSTEM MANAGEMENT CENTER (SMC) FIGS. 21 – 23 equipment

The SMC is responsible for overall management. The SMC works "on-demand" performing the main tasks of: (a) assignment of mode; (b) scheduling; (c) vehicle management; (d) train coupling and uncoupling; (e) route information; (f) detour information; (g) destination indicator control; (h) interfacing with the central operator; (i) statistics; (j) system initialization; and (k) data communication with the station equipemnt and the VCC.

Figure 21:
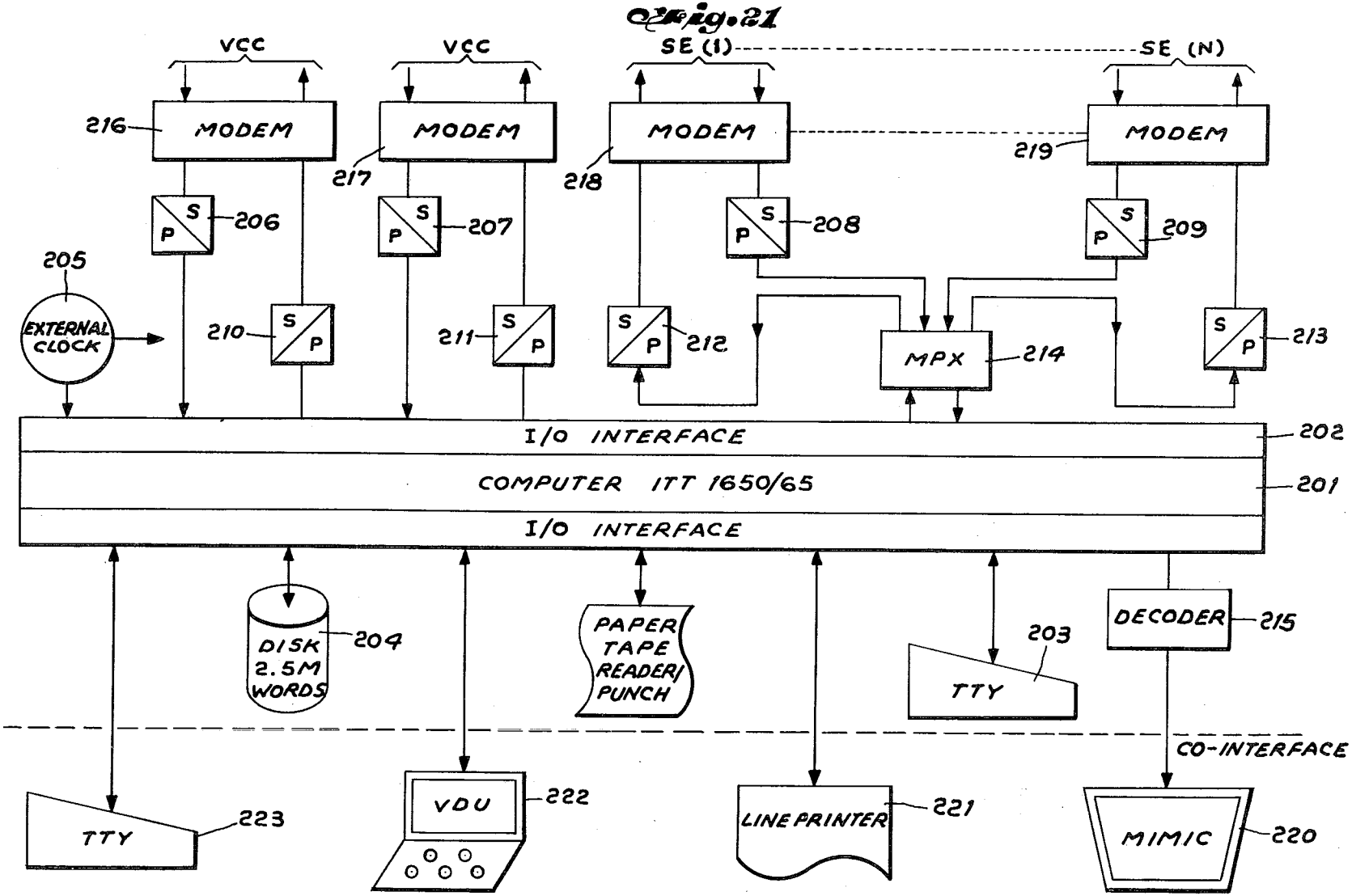
FIG. 21 is a block diagram of the system management center of FIG. 2.

Referring to FIG. 21 there is illustrated therein a block diagram of the SMC's configuration. As illustrated, the SMC comprises a computer 201, an input-output interface (I/O) 202, a teletypewriter 203, a recording disc 204, an interface rack containing the external clock 205, the serial-to-parallel converters 206 – 209, the parallel-to-serial converters 210 – 213, a multiplexer 214 and mimic decoder 215 and a data transmission rack containing the modems 216 – 219. The central operators position includes the mimic 220 which is a visual display of the system and the location of the vehicles thereon, a line printer 221, a video display unit 222 and a teletypewriter 223.

Computer 201 is the same as one of the VCC computers except that a 40k memory is used. The processing in the SMC is on-demand and has a special command, control and communication system designated TOROS (transportation oriented operating system).

The I/O interface 202 is a rack of modules similar to that used in the VCC. The modules provide the interface between the computer I/O bus and external equipment. Most of the modules are the same as those used in the VCC; namely, data input, data output, tape punch-reader, teletype and multiplex control. Other modules types are required for the visual display unit 222, the disc 224 and the line printer 221. The paper tape reader and punch are the same as those employed with the VCC computer. The teletypewriter 203 is used for maintenance and is connected directly to computer 201. Disc 204 is used to store initialization programs and data, and statistical information.

Initialization programs such as start-up and shutdown are stored on the disc to minimize core storage requirements during normal system operation. Statistical information is stored to provide off-line analysis to show trends, peaks and suggest system parameter changes which may improve system operation.

Mimic decoder 215 comprises the logic to decode 16-bit parallel words from the computer into switching signals to illuminate appropriate elements of the system mimic. The mimic elements are addressed in groups of four; up to eight bits are used for addressing. Four pairs of status bits as allocated, one pair to each element, to either illuminate the element, to switch off the illumination or to cause the illumination to flash on-off. The latter case indicates a failed vehicle. The converters and multiplexers for the link to the VCCs use standard techniques and logic under control of clock 205. In the incoming direction, the synchronization and start bits are recognized by the logic which generates shift and load pulses to input the data bits to the interface 202 as parallel words. In the outward direction, the clock 205 generates load and serial-out shift pulses to produce serial telegram bit-trains.

Figure 22:
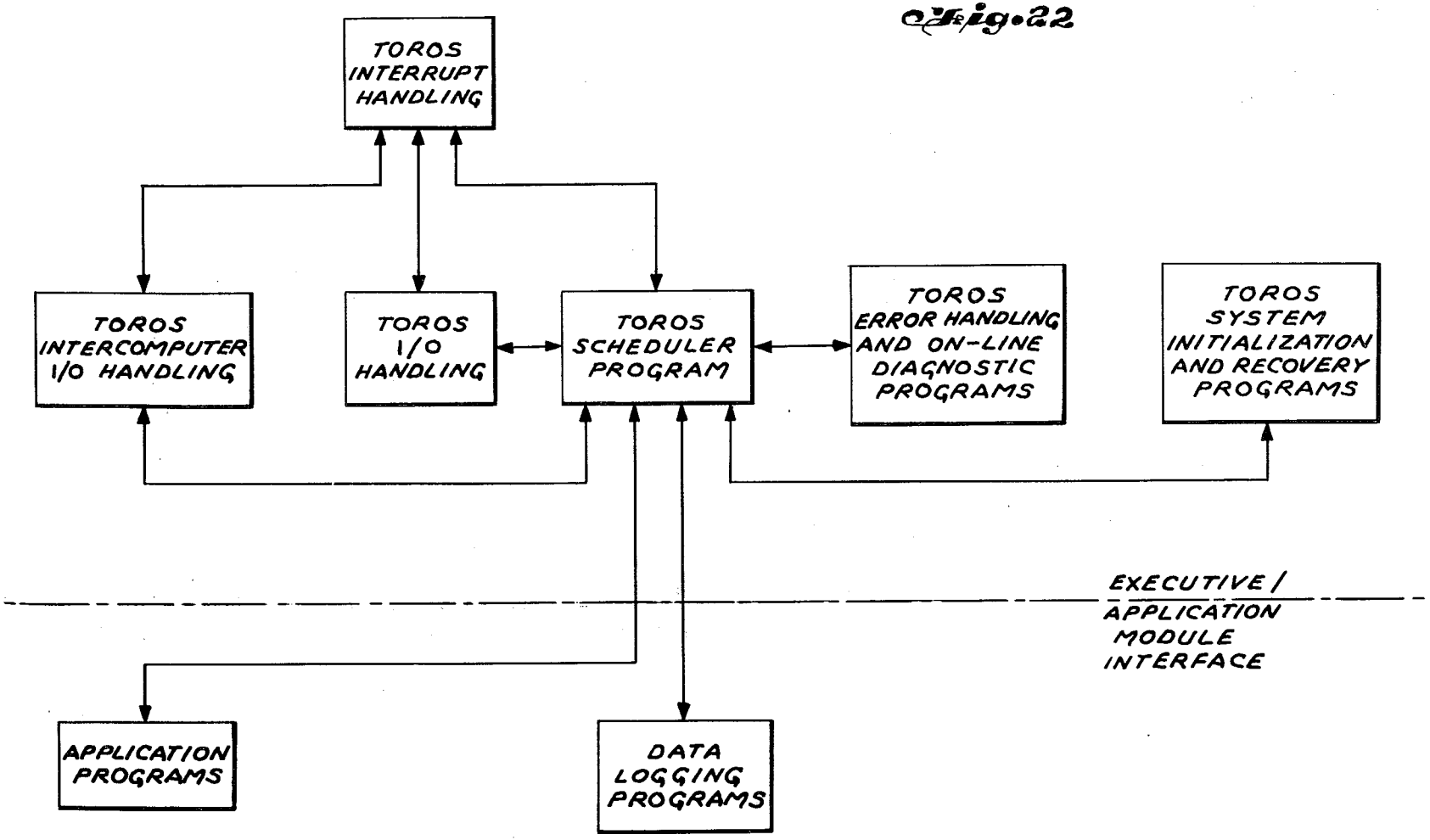
FIG. 22 is a block diagram illustrating the system management center software interaction.

Referring to FIG. 22 there is illustrated the software of the SMC which is designated TOROS and comprises the following functional parts: (a) scheduler; (b) peripheral handling; (c0 queue and buffer management; (d) time and event handling; and (e) inter-computer link handling.

The scheduler supervises the program start request queues. There are as many start request queues as there are levels of priority (there may be 256; the actual number is a system generation parameter). Any number of programs may be assigned to a particular priority level.

When a program call is made within the system, a start request is normally queued at the end of the "start request queue" which corresponds to the priority level of the called program. Provision is made, however, for calling programs at "preferred priority" within its level. This is achieved by queuing a request at the head of the relevant "start request queue."

The action of the scheduler is essentially to examine the start request queues in order of priority. The first entry in the first occupied queue is taken, and control is passed to the program represented by that entry. This is achieved by setting up the hardware registers from information stored in the queue entry and starting at the address contained in the E register. For programs contained in extended memory, the scheduler switches in the appropriate 4k memory module before passing over control.

The scheduler is entered under the following conditions: (a) when the current active program enters a delayed state; (b) when the current active program relinquishes control to the scheduler; and (c) whenever an interrupt service routine needs to call a program. Otherwise return from an interrupt service routing is made directly to the interrupted program.

In general, the system is designed for full multi-programming capability. Re-entrant programs and scheduled sub-routines are supported.

Peripheral handling is confined to purely physical functions. Block transfers of data in both directions are possible and the interface macro set has been designed to allow some measure of device independence. The peripherals supported are: (a) disc; (b) line printer; (c) paper tape reader; (d) paper tape punch; (e) magnetic tape unit; (f) teletype; (g) teletype-compatible visual display unit; (h) intercomputer communication; and (i) mimic.

Error conditions which are not recoverable at the physical level are clearly and comprehensively reported to the program using available system macros.

Queue and buffer management is concerned with the supervision of those parts of the core store which are available for use by all programs. Queue space is available in sets of 16 words. Facilities exist for linking cells together to form queues which are handled by a comprehensive macro set.

Buffer space is tied to a particular "file." The number of buffers assigned to a "file" and the length of these buffers can be determined at generation time. Macros are available for allocating and releasing buffers and for waiting until a buffer becomes available.

Time and event handling makes up the facility for starting programs or continuing with a program which is dependent on the time of day or on the occurrence of a specific event. An event is reported to TOROS by the user with a macro so that the structure is not specific to any particular application.

Inter-computer handling is concerned with the handling of the data link between the SMC computer and other components within the system. The system undertakes certain logical functions in addition to the purely physical input/output and interrupt handling. These functions include telegram buffering, repetition in the case of faulty transmission and the checking of input telegrams for accurate reception.

Figure 23:
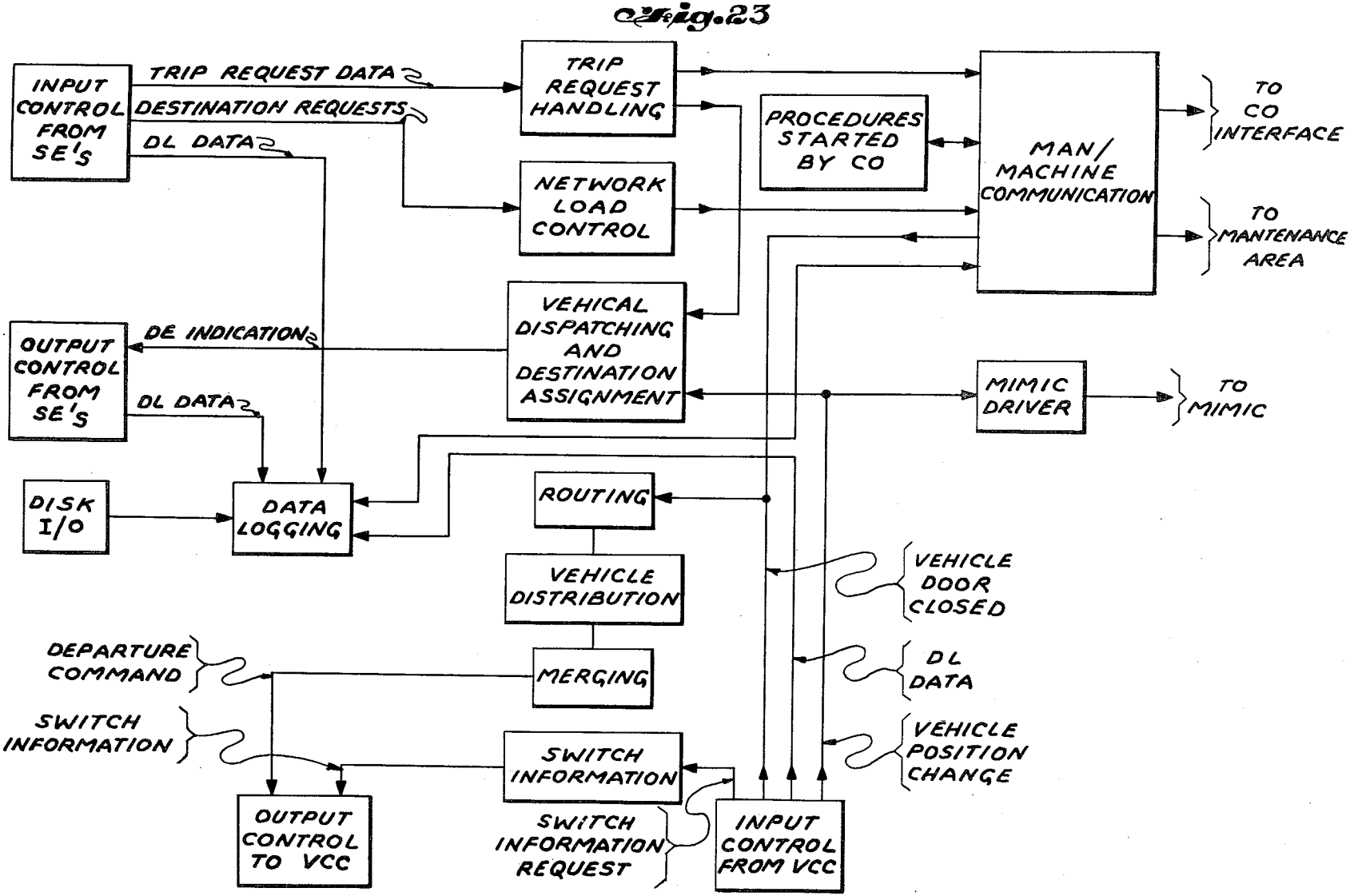
FIG. 23 is a block diagram illustrating the system management center functional interaction.

Referring to FIG. 23 there is illustrated therein the functional interaction that takes place in the SMC.

While I have described above the principles of my invention in connection with specific apparatus it is to be clearly understood tht this description is made only by way of example and not as a limitation to the scope of my invention as set forth in the objects thereof and in the accompanying claims.

We claim:

1. A system for the demand-dependent control of guided vehicles where the equipment necessary of demand registration and control are organized hierarchically comprising:

an uppermost hierarchy level including an operations control center, and a plurality of station equipment each coupled to said operations control center by a two-way communication path, said operations control center initiating commands in accordance with destination demands at each of said plurality of station equipment;

an intermediate hierarchy level including at least one commad and control center coupled to associated ones of said plurality of station equipment by a two-way communication path and coupled to said operations control center by a two-way communication path, said command and control center checks commands received from said operations control center and said associated ones of said plurality of station equipment giving special consideration to safety criteria; and a last hierarchy level including a plurality of vehicles coupled to said command and control center by a two-way communication way to perform the requested tasks in commands received from said command and control center and continuously exchanges information with said command and control center.

2. A system according to claim 1, wherein said intermediate hierarchy level includes a plurality of command and control centers each controlling a section of a guideway carrying said vehicles.

3. A system according to claim 1, wherein each of said vehicles includes a device by which a passenger can cause a stop at the next station.

4. A system according to claim 1, wherein each of said vehicles contains an intercommunication system through which a passenger can communicate with an operator in an emergency and through which said operator can make general announcements.

5. A system according to claim 1, wherein said station equipment includes a destination keyboard, and a turnstile connected to said keyboard, said keyboard being operated by a passenger to communicate his destination to the system.

6. A system according to claim 1, wherein said command and control center can operate the system if said station equipment or said operations control center fails.

* * * * *